US008356974B2

(12) United States Patent
Inomata et al.

(10) Patent No.: US 8,356,974 B2
(45) Date of Patent: Jan. 22, 2013

(54) STEAM TURBINE AND METHOD OF COOLING STEAM TURBINE

(75) Inventors: Asako Inomata, Yokohama (JP); Katsuya Yamashita, Tokyo (JP); Koji Yamaguchi, Yokohama (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 606 days.

(21) Appl. No.: 12/499,228

(22) Filed: Jul. 8, 2009

(65) Prior Publication Data

US 2010/0008756 A1 Jan. 14, 2010

(30) Foreign Application Priority Data

Jul. 11, 2008 (JP) ..... 2008-181626

(51) Int. Cl.
*F01D 11/06* (2006.01)
*F01D 25/08* (2006.01)

(52) U.S. Cl. ..... 415/174.5; 415/1; 415/14; 415/116; 415/118

(58) Field of Classification Search ..... 415/14, 415/111, 112, 116, 118, 170.1, 174.5, 230, 415/1

See application file for complete search history.

(56) References Cited

U.S. PATENT DOCUMENTS

| | | | | |
|---|---|---|---|---|
| 5,388,960 | A * | 2/1995 | Suzuki et al. | 415/176 |
| 6,382,903 | B1 * | 5/2002 | Caruso et al. | 415/1 |
| 7,798,767 | B2 * | 9/2010 | Kondo et al. | 415/108 |
| 7,985,045 | B2 * | 7/2011 | Narita et al. | 415/14 |
| 2006/0239813 | A1 * | 10/2006 | Shah et al. | 415/119 |
| 2007/0189890 | A1 * | 8/2007 | Snowsill et al. | 415/115 |

FOREIGN PATENT DOCUMENTS

| | | | |
|---|---|---|---|
| JP | 05033603 | * | 2/1993 |
| JP | 3617661 | B2 | 11/2004 |
| JP | 2006-017016 | A | 1/2006 |

OTHER PUBLICATIONS

Kondo, Steam Turbine, Feb. 9, 1993, JP05033603 abstract.*

* cited by examiner

*Primary Examiner* — Ninh H Nguyen
*Assistant Examiner* — Liam McDowell
(74) *Attorney, Agent, or Firm* — Foley & Lardner LLP

(57) ABSTRACT

A steam turbine 20 is provided with a casing 109, a turbine rotor 25 disposed through the casing 109, and labyrinth portions 50, 55 which are disposed at the boundary between the casing 109 and the turbine rotor 25. The steam turbine 20 is further provided with a sealing steam pipe 65 for supplying sealing steam to the labyrinth portions 50, 55 and a gas supply pipe 60 for supplying the labyrinth portions 50, 55 with a cooling gas for cooling the turbine rotor 25 or a heating gas for heating the turbine rotor 25.

5 Claims, 20 Drawing Sheets

STEAM TURBINE AND METHOD OF COOLING STEAM TURBINE

CROSS-REFERENCE TO RELATED APPLICATIONS

This application is based upon and claims the benefit of priority from the prior Japanese Patent Application No. 2008-181626, filed on Jul. 11, 2008; the entire contents of which are incorporated herein by reference.

BACKGROUND

1. Field of the Invention

The present invention relates to a steam turbine, which is capable of cooling or heating a turbine rotor by air or the like, and a method of cooling a steam turbine.

2. Description of the Related Art

Generally, during a start-up of a steam turbine, a turbine rotor, lots of parts of which are directly exposed to high-temperature steam, has a quick temperature increase, while a casing, having a large thermal capacity, has a slow temperature increase. Here the casing means stationary portions of the steam turbine.

FIG. 20 is a diagram showing a thermal expansion difference, which is a difference between an axial expansion amount of the turbine rotor and an axial moving distance of seal fins of a labyrinth portion due to an axial expansion of the casing during the start-up of the steam turbine.

As shown in FIG. 20, during the start-up of the steam turbine, the turbine rotor rotates at a low speed even if the mainstream of steam has a small flow rate, its temperature is increased gradually by windage loss or the like, and an axial expansion amount of the turbine rotor is increased. Meanwhile, since a casing part including the labyrinth portion has a large thermal capacity, the temperature increase becomes moderate. Therefore, a temperature difference is produced in the casing part including the turbine rotor and the labyrinth portion, a difference (thermal expansion difference) is generated between an axial expansion amount of the turbine rotor and an axial moving distance of the labyrinth portion due to an axial expansion of the casing. This thermal expansion difference increases with the lapse of time from the start-up to indicate a maximum value (maximum thermal expansion difference) and decreases as it approaches the rated condition.

Thus, when the thermal expansion difference is produced in the axial direction of the turbine rotor by the turbine rotor and the seal fins of the labyrinth portion, there is a possibility that protruded threads formed on the circumferential surface of the turbine rotor and the seal fins of the labyrinth portion are contacted (rubbing).

To avoid such a contact, the conventional steam turbine increases the gap of the labyrinth portion or increases the temperature over a long time so that the temperature difference between the turbine rotor and the casing part including the labyrinth portion becomes small at the start of the steam turbine. But, to improve the performance of the steam turbine in recent years, there is a desire for a decrease in the gap of the labyrinth portion or for a decrease in the start-up time of the steam turbine to decrease the waiting time of a quick start-up gas turbine of a combined cycle plant.

To decrease the thermal expansion difference between the turbine rotor and the casing part including the labyrinth portion, it is necessary to decrease the individual temperature differences. To do so, it is considered to heat the casing which is slow in temperature increase or to cool the turbine rotor which is quick in temperature increase. When the steam turbine is stopped, a decrease in temperature of the casing having a large thermal capacity becomes moderate, and a decrease in temperature of the turbine rotor having a small thermal capacity becomes quick.

As a steam turbine which prevents a contact of the labyrinth portion due to such a thermal expansion difference, for example, JP-A 2006-17016 (KOKAI) discloses a technology of heating the casing by steam with a steam passage disposed in a flange portion, whose temperature increase is most pronounced at the start of the steam turbine in the casing.

But, since the above-described conventional steam turbine, which heats the flange portion of the casing by steam at the start of it, is provided with a mechanism of heating the casing, it has a disadvantage that the casing has a complex structure. Since a large amount of steam was required to heat the casing having a large thermal capacity, improvement of the steam turbine efficiency was hindered. Besides, time for heating the casing having a large thermal capacity is required, and there was a problem that it took time to start the steam turbine.

BRIEF SUMMARY OF THE INVENTION

The present invention provides a steam turbine which can decrease a thermal expansion difference between a turbine rotor and a labyrinth portion in the axial direction of the turbine rotor and which can decrease a start-up time, and a method of cooling a steam turbine.

According to an aspect of the present invention, there is provided a steam turbine, comprising a casing; a turbine rotor disposed through the casing; a labyrinth portion circumferentially provided between the casing and the turbine rotor; and a gas supply pipe supplying cooling air for cooling the turbine rotor to the labyrinth portion at the start of the steam turbine.

According to another aspect of the present invention, there is provided a method of cooling a steam turbine including a casing; a turbine rotor disposed through the casing; a labyrinth portion circumferentially provided between the casing and the turbine rotor along the turbine rotor; a sealing steam supply pipe that supplies sealing steam to the labyrinth portion; a gas supply pipe that supplies cooling air for cooling the turbine rotor to the labyrinth portion at the start of the steam turbine; an expansion detector that detects an amount of a thermal expansion of the turbine rotor in the axial direction; and a movement detector that detects an axial moving distance of a sealing portion at the labyrinth portion in the axial direction of the turbine rotor; wherein the method comprises: adjusting a supply amount of cooling air from the gas supply pipe according to detection information from the expansion detector and the movement detector; adjusting a supply amount of sealing steam from the sealing steam supply pipe; and calculating a thermal expansion difference, which is a difference between the amount of the thermal expansion of the turbine rotor and the axial moving distance of the sealing portion, according to the detection information from the expansion detector and the moving detector, wherein the supply amount of the cooling air is adjusted in correspondence with an increase in the thermal expansion difference while the supply amount of the sealing steam is adjusted at a predetermined amount when the thermal expansion difference is calculated to be increasing, wherein the supply amount of the cooling air is adjusted to decrease while the supply amount of the sealing steam is adjusted to increase when the thermal expansion difference is calculated to be decreasing.

According to another aspect of the present invention, there is provided a method of cooling a steam turbine including a casing; a turbine rotor disposed through the casing; a labyrinth portion circumferentially provided between the casing and the turbine rotor along the turbine rotor; a sealing steam supply pipe that supplies sealing steam to the labyrinth portion; a gas supply pipe that supplies cooling air for cooling the turbine rotor to the labyrinth portion at the start of the steam turbine; an expansion detector that detects an amount of a thermal expansion of the turbine rotor in the axial direction; and a movement detector that detects an axial moving distance of a sealing portion at the labyrinth portion in the axial direction of the turbine rotor; wherein the method comprising: adjusting a supply amount of cooling air from the gas supply pipe according to detection information from the expansion amount detection unit and the movement detector; adjusting a supply amount of sealing steam from the sealing steam supply pipe; and calculating a thermal expansion difference, which is a difference between the amount of the thermal expansion of the turbine rotor and the axial moving distance of the sealing portion, according to the detection information from the expansion detector and the moving detector, wherein the supply amounts of the cooling air and the sealing steam is adjusted to a predetermined amounts, respectively, from the beginning of a start-up of the steam turbine, wherein the supply amount of the cooling air is adjusted to decrease while the supply amount of the sealing steam is adjusted to increase when the thermal expansion difference is calculated to be decreasing.

BRIEF DESCRIPTION OF THE DRAWINGS

The present invention is described with reference to the drawings, which are provided for illustration only and do not limit the present invention in any aspect.

DETAILED DESCRIPTION OF THE INVENTION

One embodiment of the present invention is described below with reference to the drawings.

Figure 1:
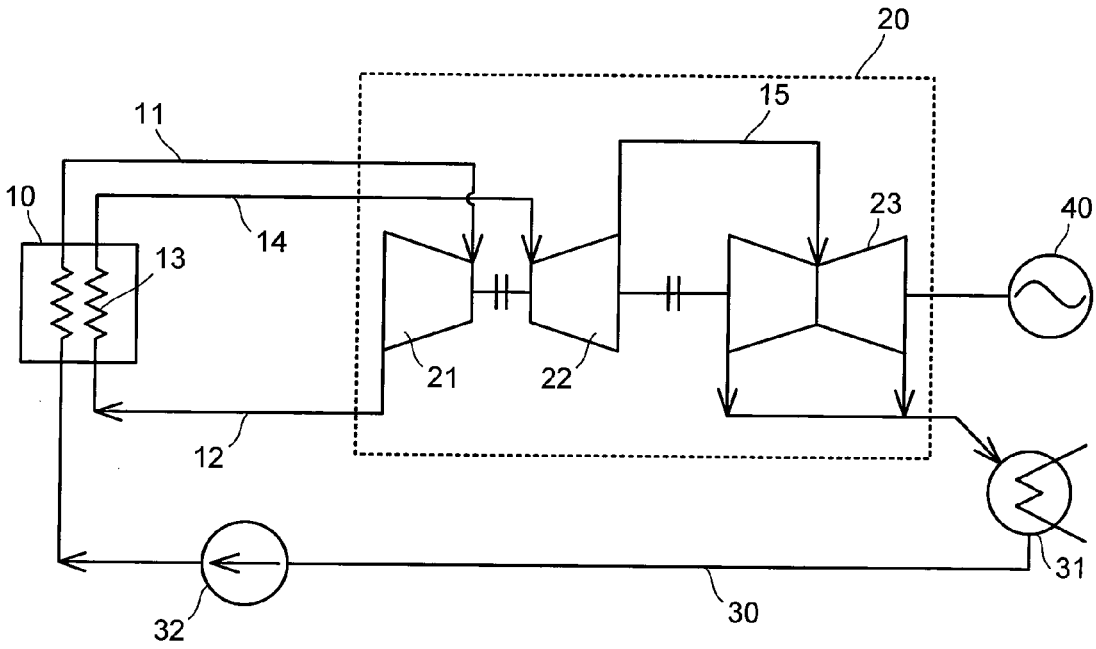
FIG. 1 is a diagram showing an outline of an example of a power plant provided with a steam turbine according to an embodiment of the invention.
Figure 2:
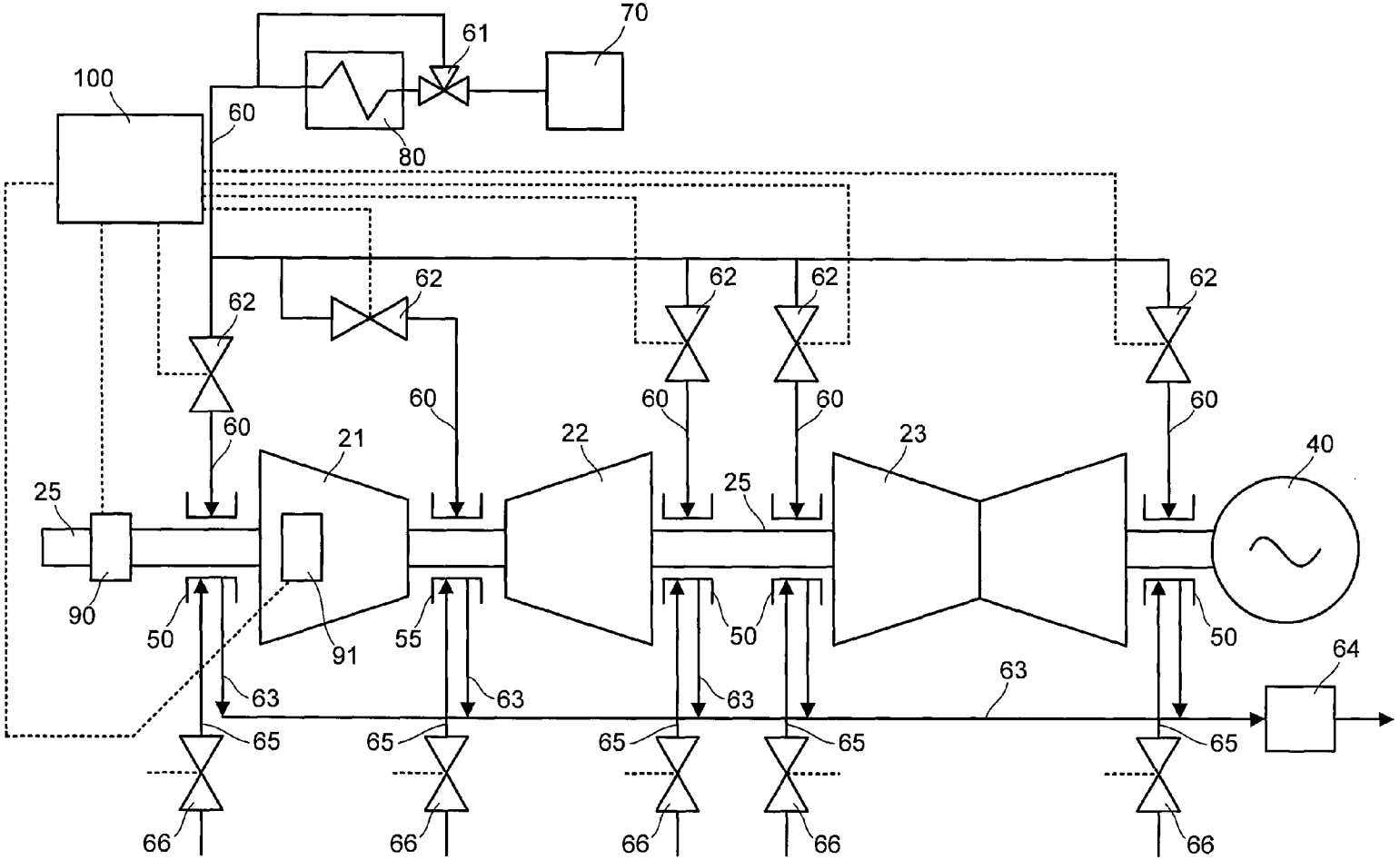
FIG. 2 is a diagram showing an outline of an example of a gas supply system which supplies a cooling gas or a heating gas to a labyrinth portion of the steam turbine according to an embodiment of the invention.
Figure 3:
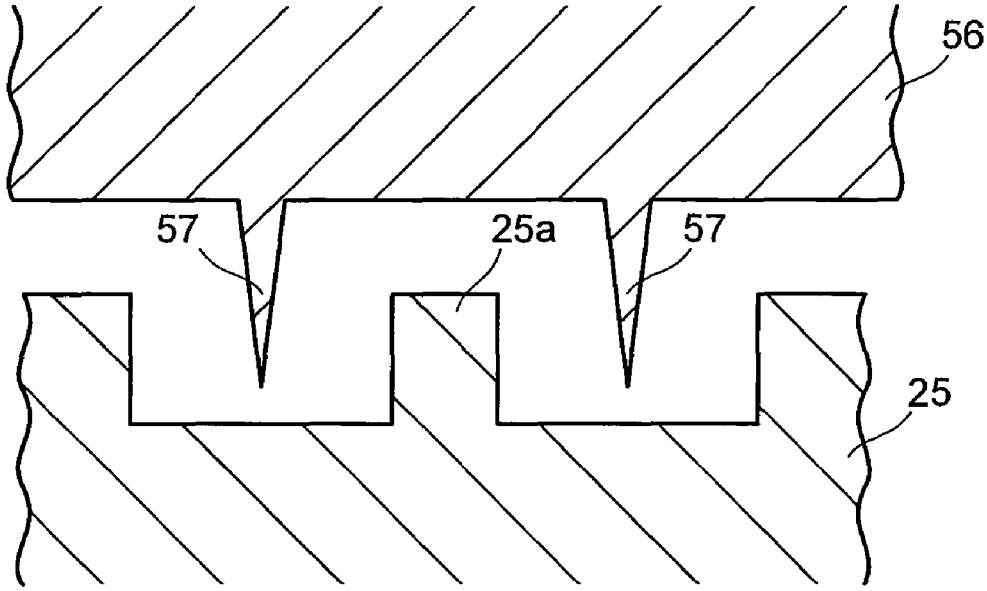
FIG. 3 is a diagram showing an example of a cross sectional structure of the labyrinth portion.

FIG. 1 is a diagram showing an outline of an example of a power plant provided with a steam turbine 20 according to an embodiment of the invention. FIG. 2 is a diagram showing an outline of an example of a gas supply system which supplies a cooling gas or a heating gas to a labyrinth portion of the steam turbine 20 according to an embodiment of the invention. FIG. 3 is a diagram showing an example of a cross sectional structure of the labyrinth portion.

As shown in FIG. 1, a power plant is configured by combining a steam generator 10, which consists of a boiler and the like, with the steam turbine 20 and a condensate supply system 30.

The steam turbine 20 provided in the power plant includes a high-pressure turbine 21, an intermediate-pressure turbine 22 and a low-pressure turbine 23, and the steam turbine 20 and an electric generator 40 are axial connected through a turbine rotor 25.

The condensate supply system 30 is a passage through which a turbine exhaust steam having performed the expansion work in the steam turbine 20 is returned to the steam generator 10, and this passage has a condenser 31 and a feed-water pump 32.

In this power plant, the steam that flows out of the steam generator 10 is supplied to the high-pressure turbine 21 through a main steam pipe 11 and exhausted from the high-pressure turbine 21 after completing the expansion work. The steam discharged from the high-pressure turbine 21 is supplied to a reheater 13 through a low-temperature reheating pipe 12, reheated in it and supplied to the intermediate-pressure turbine 22 through a high-temperature reheating pipe 14. The steam supplied to the intermediate-pressure turbine 22 performs expansion work and is supplied to the low-pressure turbine 23 through a crossover pipe 15. The steam supplied to the low-pressure turbine 23 performs expansion work and is discharged from the low-pressure turbine 23. The electric generator 40 is driven to rotate by power produced by the expansion work of steam of the steam turbine to generate electric power. The steam discharged from the low-pressure turbine 23 is condensed by the condenser 31 disposed on the condensate supply system 30. The condensed water condensed by the condenser 31 is undergone a pressure increase by the feed-water pump 32 and returned to the steam generator 10.

The gas supply system for supplying the cooling gas or the heating gas to the labyrinth portion in the steam turbine 20 is described below.

As shown in FIG. 2, gland labyrinth portions 50, which are disposed to prevent a leakage of steam or an inflow of air, and an intermediate labyrinth portion 55, which suppresses an inflow of steam from a high-pressure side steam turbine to a low-pressure side steam turbine when two types of steam turbines are provided in one casing, are connected to a gas supply portion 70 for supplying the cooling gas or the heating gas through a gas supply pipe 60. The gas supply pipe 60 is branched into a passage for flowing the cooling gas, which flows out of the gas supply portion 70, to the side provided with a heat exchanger 80 for heating and a passage for flowing the gas without any change and combined into one passage at downstream thereof. The cooling gas becomes the heating gas by flowing through the passage which is provided with the heat exchanger 80 for heating. And, the branched portion is provided with a switching valve 61, which can be switched to split the flow of the cooling gas that flows out of the gas supply portion 70 to the passage provided with the heat exchanger 80 or the passage for flowing without any change.

The gas supply pipe 60 is branched, and its ends are communicated with the gland labyrinth portions 50 and the intermediate labyrinth portion 55. The individual branched gas supply pipes 60 are provided with a flow control valve 62 which is configured of a valve for adjusting a flow rate. And, the gland labyrinth portions 50 and the intermediate labyrinth portion 55 are provided with a recovery pipe 63 for recovering the supplied gas, and the cooling gas or the heating gas recovered through the recovery pipe 63 is guided to a gland condenser 64. The cooling gas or the heating gas guided to the recovery pipe 63 contains sealing steam to be supplied to the individual labyrinth portions described later. The gland condenser 64 is a device for separating a gas configuring the cooling gas or the heating gas and the sealing steam. The sealing steam is condensed for separation by the gland condenser 64, and its condensed water is guided to the condenser 31. The separated cooling gas or the heating gas may be discharged into the atmosphere or circulated for use.

The individual structures for supplying the cooling gas or the heating gas from the above-described gas supply portion 70 to the gland labyrinth portions 50 and the intermediate labyrinth portion 55 function as a gas supply. The cooling gas is used to cool down the turbine rotor 25 at the start of the steam turbine, while the heating gas is used to heat the turbine rotor 25 during the shutdown operation of the steam turbine.

Here, air in the atmosphere is used as the cooling gas or the heating gas. For example, to decrease windage loss which is caused by rotations of the turbine rotor 25, a mixture of air with, for example, helium having a density smaller than air may be used as the cooling gas or the heating gas. The cooling gas desirably has a temperature of 80 to 250° C. to prevent a temperature increase of the turbine rotor 25 and to prevent steam from condensation. And, the heating gas desirably has a temperature in a range of about 340 to 400° C. to decrease a temperature difference between the turbine rotor 25 and the casing.

Sealing steam pipes 65 for supplying the sealing steam are connected to the gland labyrinth portions 50 and the intermediate labyrinth portion 55, the individual sealing steam pipes 65 are provided with a flow control valve 66 which is configured of a valve for adjusting a flow rate. As the sealing steam, for example, steam extracted from a steam generator is used. The sealing steam desirably has a temperature in a range of room temperature to a rated steam temperature to prevent generation of a local thermal stress.

As shown in FIG. 2, the turbine rotor 25 is provided with an expansion detector 90 that detects an axial expansion amount of the turbine rotor 25. Namely, the expansion detector 90 measures, for example, an axial distance of a predetermined position of the turbine rotor 25 before and after a movement due to a thermal expansion. This expansion detector 90 is configured of a displacement sensor or the like. As the displacement sensor, a noncontact type which has light, magnetic field or sound waves as a medium, or a contact type such as a dial gauge or a differential transformer can be used. Among them, it is desirable to use a noncontact type of displacement sensor having light as the medium and especially characterized by a high precision and a fast response speed.

The gland labyrinth portions 50 and the intermediate labyrinth portion 55 are provided with a movement detector 91 for detecting an axial moving distance of seal fins of a labyrinth packing (i.e. the gland labyrinth portions 50 and the intermediate labyrinth portion 55). As shown in FIG. 3, the labyrinth packing 56 (i.e. the gland labyrinth portions 50 and the intermediate labyrinth portion 55) is provided with seal fins 57, which are circumferentially protruded toward the turbine rotor 25, at predetermined intervals in the axial direction of the turbine rotor 25. And, protruded threads **25*a* which are circumferentially protruded toward the radial direction of the turbine rotor 25 are formed on the surface of the turbine rotor 25. The protruded threads 25*a* are provided at prescribed intervals in the axial direction of the turbine rotor 25, and the seal fins 57 each are arranged between the protruded threads 25*a*. Here, labyrinth packing 56 constitutes a part of the casing of the steam turbine. The above-described movement detector 91 detects an axial moving amount of the seal fins 57, namely a moving distance. For example, the movement detector 91** is configured of a displacement sensor or the like. As the displacement sensor, a noncontact type which has light, magnetic fields or sound waves as a medium, or a contact type such as a dial gauge or a differential transformer can be used. Among them, it is especially desirable to use a noncontact type of displacement sensor having light as the medium and especially having characteristics such as a high precision and a fast response speed.

The gas supply system is provided with a controller 100, and the above-described switching valve 61, flow control valves 62, 66, expansion detector 90 and movement detector 91 are electrically connected to the controller 100 as indicated by the dotted lines on FIG. 2. The controller 100 controls the switching valve 61 and the flow control valves 62, 66 according to the detection information from the expansion detector 90 and the movement detector 91 and adjusts the supply amounts of the cooling gas, the heating gas and the sealing steam.

FIG. 2 shows an example that the expansion detector 90 is disposed on the turbine rotor 25 near the high-pressure turbine 21, and the movement detector 91 is disposed at the labyrinth portion of the high-pressure turbine 21, but such a configuration is not exclusive. For example, the expansion detector 90 and the movement detector 91 may be provided in correspondence with the individual steam turbines.

Then, the structures of portions to supply the cooling gas or the heating gas to the gland labyrinth portions 50 and the intermediate labyrinth portion 55 are described below.

First, the structure of a portion to supply the cooling gas or the heating gas to the gland labyrinth portion 50 is described.

Figure 4:
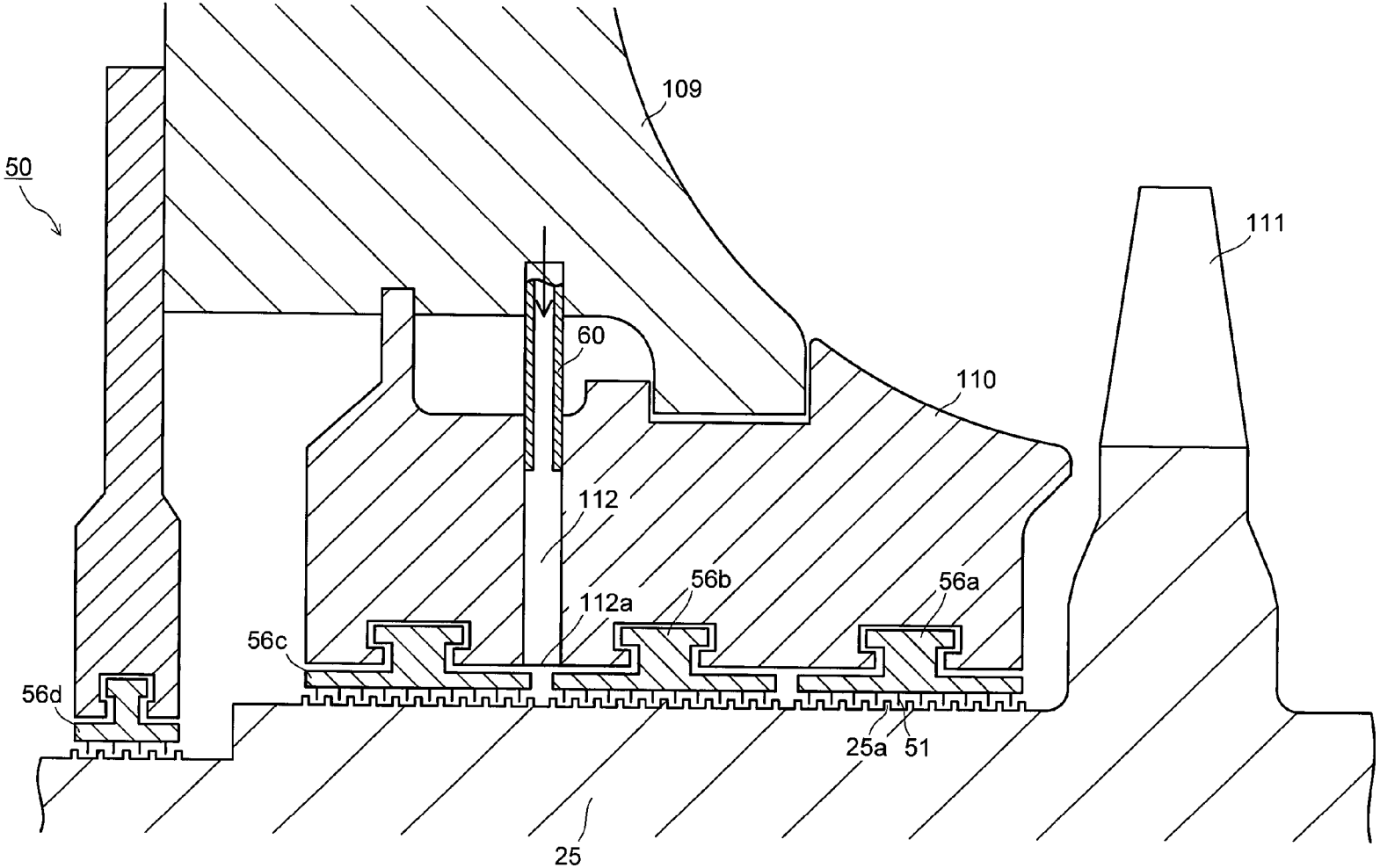
FIG. 4 is a diagram showing a cross section of an outlet side of the steam turbine having a structure to supply a cooling gas or a heating gas to a gland labyrinth portion.
Figure 5:
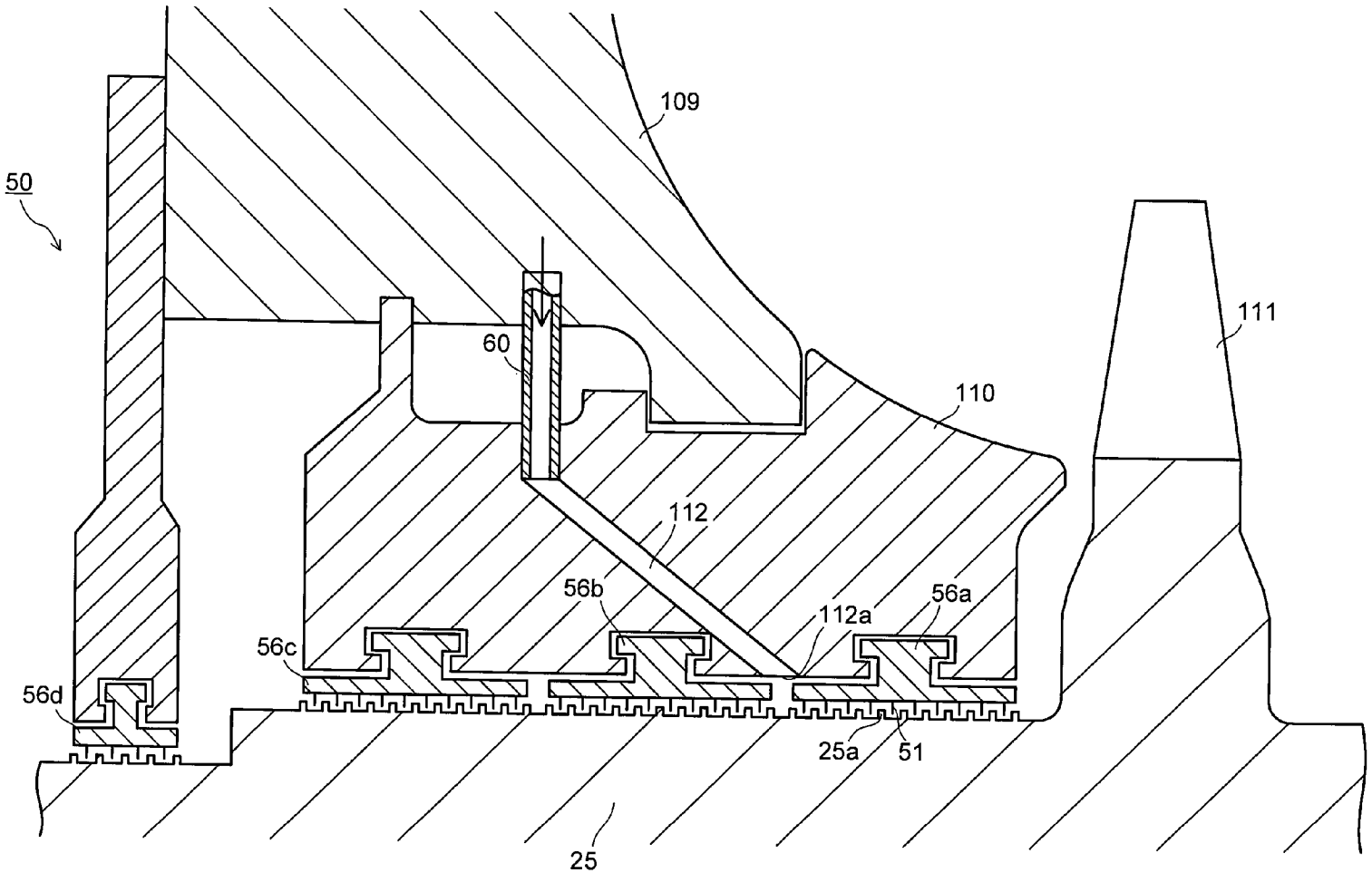
FIG. 5 is a diagram showing a cross section of an outlet side of the steam turbine having another structure to supply a cooling gas or a heating gas to the gland labyrinth portion.
Figure 6:
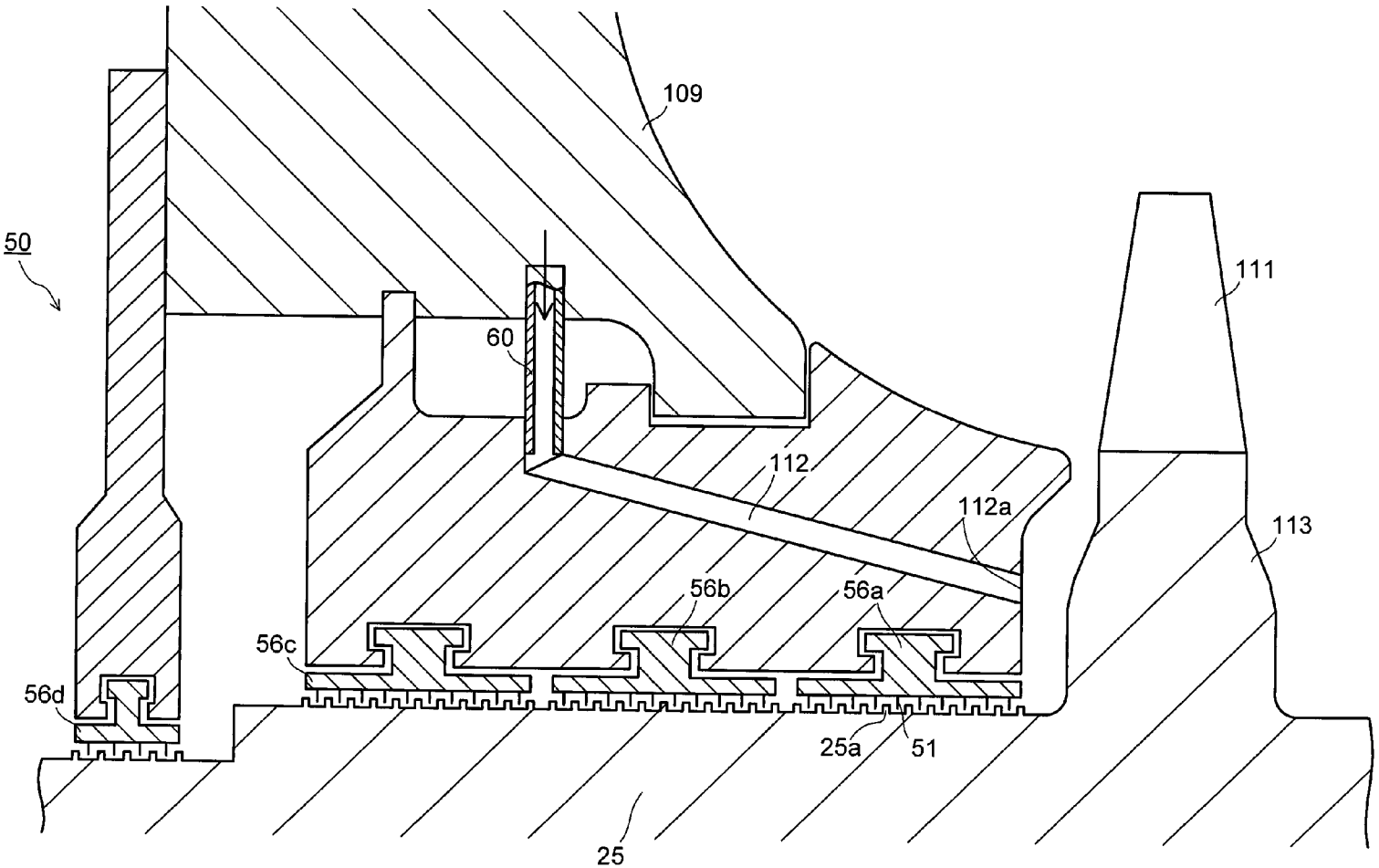
FIG. 6 is a diagram showing a cross section of an outlet side of the steam turbine having another structure to supply a cooling gas or a heating gas to the gland labyrinth portion.
Figure 7:
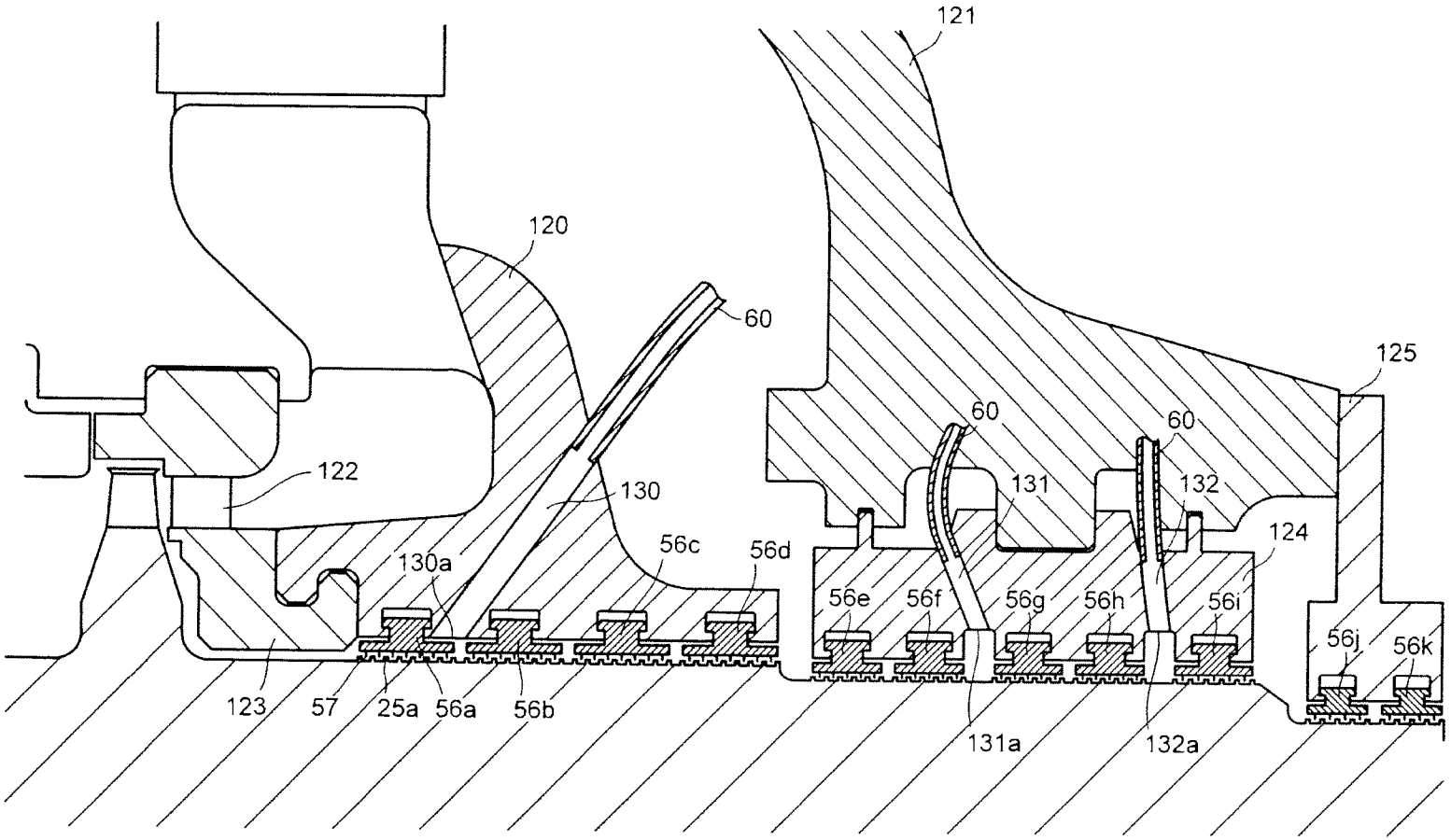
FIG. 7 is a diagram showing a cross section of an inlet side of the steam turbine provided with a double-structure casing having a structure to supply a cooling gas or a heating gas to the gland labyrinth portion.
Figure 8:
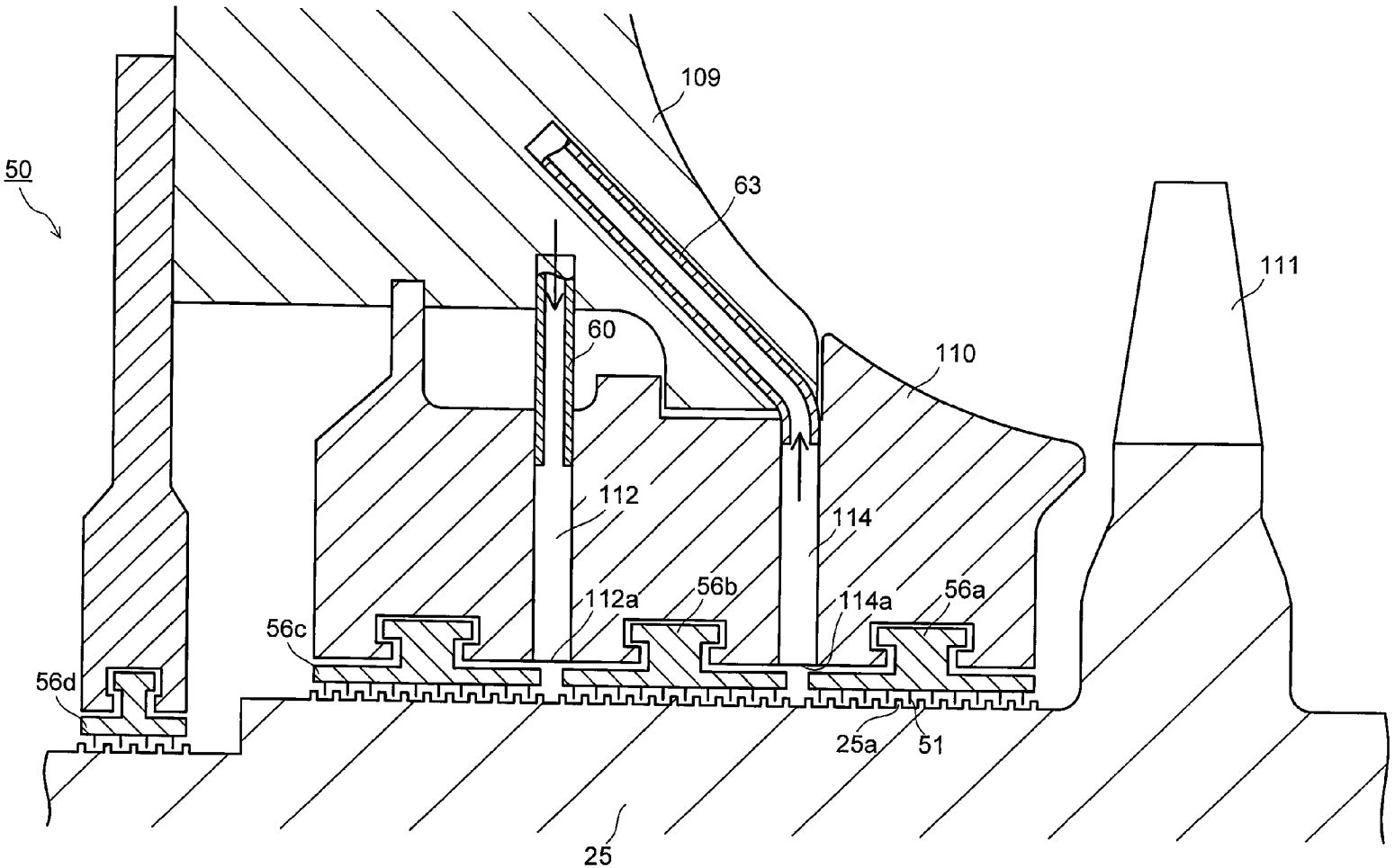
FIG. 8 is a diagram showing a cross section of an outlet side of the steam turbine having a structure to supply a cooling gas or a heating gas to the gland labyrinth portion and a structure to exhaust such gases.
Figure 9:
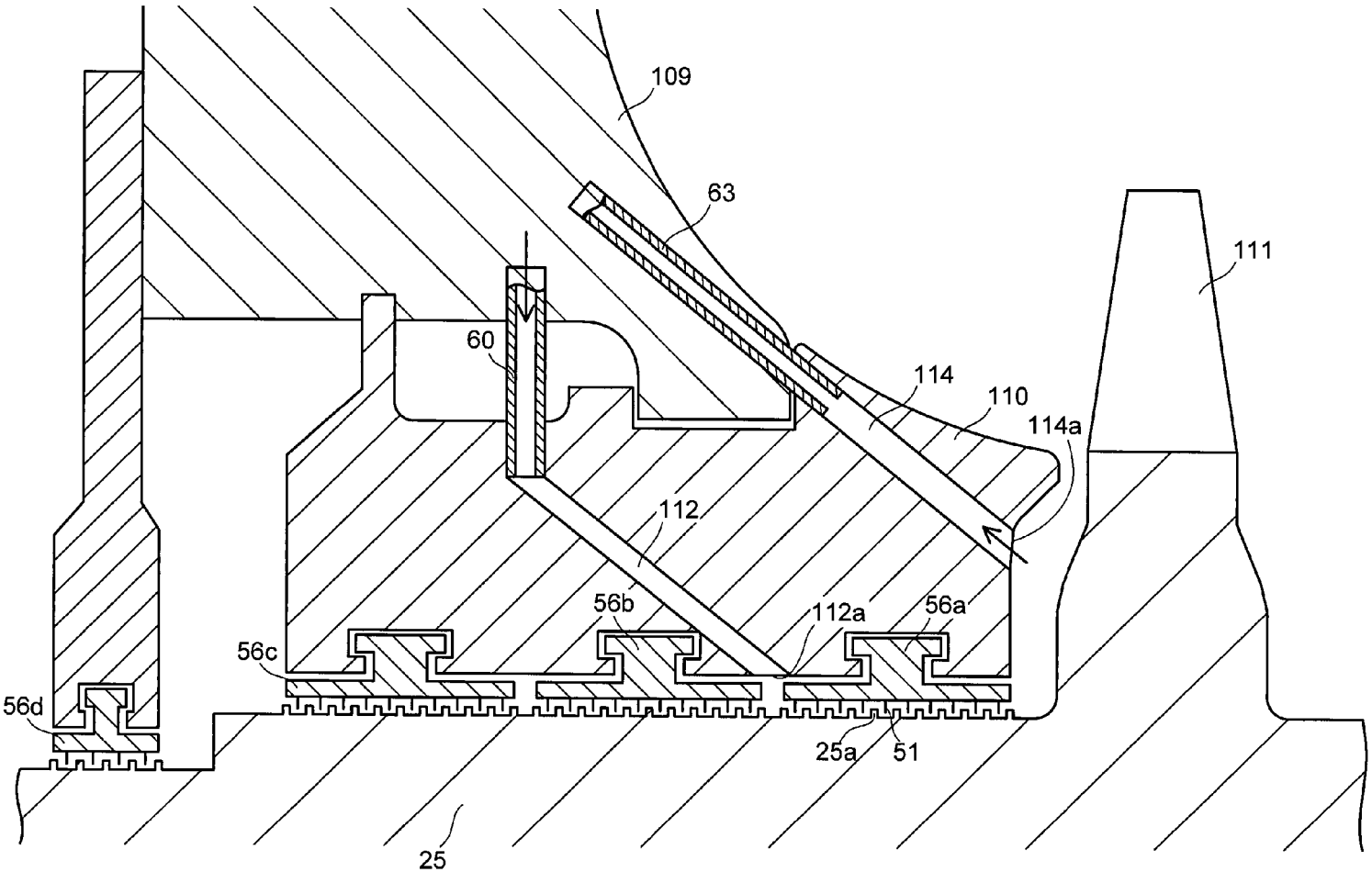
FIG. 9 is a diagram showing a cross section of an outlet side of the steam turbine having a structure to supply a cooling gas or a heating gas to the gland labyrinth portion and a structure to exhaust such gases.

FIG. 4 is a diagram showing a cross section of an outlet side of a steam turbine having a structure to supply the cooling gas or the heating gas to the gland labyrinth portion 50. FIG. 5 and FIG. 6 are diagrams showing cross sections of outlet sides of steam turbines having another structure to supply the cooling gas or the heating gas to the gland labyrinth portion 50. FIG. 7 is a diagram showing a cross section of an inlet side of a steam turbine having a double-structure casing having a structure to supply the cooling gas or the heating gas to the gland labyrinth portion 50. FIG. 8 and FIG. 9 are diagrams showing cross sections of outlet sides of steam turbines having a structure to supply the cooling gas or the heating gas to the gland labyrinth portion 50 and a structure to discharge such gases.

As shown in FIG. 4, the labyrinth packing 56 configuring the gland labyrinth portion 50 is fixed to a diaphragm 110, which is fixed to a casing 109. Diaphragm 110 and labyrinth packing 56, which constitute a part of the casing 109, are circumferentially provided along the turbine rotor 25 between a final stage of the turbine rotor blade 111 and the outside of the steam turbine. FIG. 4 shows an example having four labyrinth packings 56*a*, 56*b*, 56*c* and 56*d* as the labyrinth packing 56 which seals steam inside of the steam turbine from an outside. In the diaphragm 110, a through hole 112 is formed to run through between the second labyrinth packing 56*b* and the third labyrinth packing 56*c* counting from the final stage of the turbine rotor blade 111 toward the outside of the steam turbine, and the gas supply pipe 60 is connected to the through hole 112 to communicate with it. In other words, it is configured that an open end portion 112*a* of the through hole 112 is formed between the second labyrinth packing 56*b* and the third labyrinth packing 56*c* counting from the final stage of the turbine rotor blade 111 toward the outside of the steam turbine, and the cooling gas or the heating gas is ejected from the open end portion 112*a*. And, the sealing steam is supplied to the gland labyrinth portion 50 by an unshown sealing steam pipe 65.

A pressure near the turbine rotor blade 111 at the start or stop of the steam turbine is low, and the cooling gas or the heating gas, which is supplied at a pressure higher than the above pressure to between the labyrinth packing 56*b* and the labyrinth packing 56*c* through the gas supply pipe 60 and the through hole 112, flows between the turbine rotor 25 and the gland labyrinth portion 50 in a direction toward the turbine rotor blade 111 and a direction toward the outside of the steam turbine. The cooling gas or the heating gas flowing in the direction toward the outside of the steam turbine is guided from between, for example, the labyrinth packing 56*c* and the labyrinth packing 56*d* to the gland condenser 64 through the recovery pipe 63. As described above, since the gland labyrinth portion 50 is also supplied with the sealing steam through the sealing steam pipe 65, the sealing steam is also guided together with the cooling gas or the heating gas to the gland condenser 64 through the recovery pipe 63. Thus, the turbine rotor 25 can be cooled or heated.

As shown in FIG. 5, the through hole 112 is formed in the diaphragm 110 to run through between the first labyrinth packing 56*a* and the second labyrinth packing 56*b* counting from the final stage of the turbine rotor blade 111 toward the outside of the steam turbine, and the gas supply pipe 60 may be connected to the through hole 112 to communicate with it. In other words, it may be configured that the open end portion 112*a* of the through hole 112 is formed between the first labyrinth packing 56*a* and the second labyrinth packing 56*b* counting from the final stage of the turbine rotor blade 111 toward the outside of the steam turbine, and the cooling gas or the heating gas is ejected from the open end portion 112*a*. By configuring as described above, the side of the turbine rotor 25, which is near the turbine rotor blade 111 and has a temperature easily increased, can be cooled efficiently without increasing a supply pressure of the cooling gas.

As shown in FIG. 6, the open end portion 112*a* of the through hole 112 formed in the diaphragm 110 may be formed at a position opposed to a disk 113 for fixing the final stage of the turbine rotor blade 111. The cooling gas or the heating gas is ejected from the open end portion 112*a* toward the disk 113. The ejected cooling gas or heating gas collides against the disk 113, and it partially flows between the turbine rotor 25 and the gland labyrinth portion 50 in a direction toward the outside of the steam turbine.

By configuring as described above, the cooling gas or the heating gas can be ejected toward the disk 113 to cool or heat the disk 113 directly. For example, in a case where the cooling gas flows, the diaphragm 110 can be cooled by the cooling gas because the through hole 112 is formed in the diaphragm 110 from the labyrinth packing 56*c* side to the labyrinth packing 56*a* side. Thus, the labyrinth packings 56*a*, 56*b*, 56*c* fixed to the diaphragm 110 are prevented from having a temperature increase, and the turbine rotor 25 can be prevented from being heated by radiation heat from the labyrinth packings 56*a*, 56*b*, 56*c*.

The steam turbine shown in FIG. 7 has its casing configured of a double casing of an inner casing 120 and an outer casing 121. And, the gland labyrinth portion 50 is provided along the turbine rotor 25 at the end portions of the individual casings in an outside direction of the steam turbine. Here, four labyrinth packings 56*a*, 56*b*, 56*c*, 56*d* are provided at the end portion of the inner casing 120 from the side of a nozzle diaphragm inner ring 123 configuring a first stage nozzle 122 toward the outside along the turbine rotor 25. A diaphragm 124 which is provided at the end of the outer casing 121 located outside of the inner casing 120 is provided with five labyrinth packings 56*e*, 56*f*, 56*g*, 56*h*, 56*i* along the turbine rotor 25 toward the outside. A diaphragm 125 which is disposed outside of the outer casing 121 in the axial direction of the turbine rotor is provided with two labyrinth packings 56*j*, 56*k* along the turbine rotor 25. The number of the labyrinth packings provided to the inner casing 120, the outer casing 121 and the diaphragm 124 is not particularly limited.

A through hole 130 is formed through the inner casing 120 to have its end between the first labyrinth packing 56*a* and the second labyrinth packing 56*b* counting from the side of the nozzle diaphragm inner ring 123 configuring the first stage nozzle 122 toward the outside, and the gas supply pipe 60 is connected to the through hole 130 to communicate with it. In other words, an open end portion 130*a* of the through hole 130 is formed between the first labyrinth packing 56*a* and the second labyrinth packing 56*b* counting from the side of the nozzle diaphragm inner ring 123 configuring the first stage nozzle 122 toward the outside, thereby configuring to eject the cooling gas or the heating gas from the open end portion 130*a*.

The diaphragm 124 which is provided at the end of the outer casing 121 is formed with through holes 131, 132 to have their ends between the second labyrinth packing 56*f* and the third labyrinth packing 56*g* and between the fourth labyrinth packing 56*h* and the fifth labyrinth packing 56*i* along the turbine rotor 25 toward the outside, and the gas supply pipes 60 are connected to the through holes 131, 132 to communicate with them. In other words, open end portions 131*a*, 132*a* of the through holes 131, 132 are formed between the second labyrinth packing 56*f* and the third labyrinth packing 56*g* and between the fourth labyrinth packing 56*h* and the fifth labyrinth packing 56*i* along the turbine rotor 25 toward the outside, thereby configuring to eject the cooling gas or the heating gas from the open end portions 131*a*, 132*a*.

The sealing steam is supplied to the gland labyrinth portion 50 through an unshown sealing steam pipe 65.

The cooling gas or the heating gas supplied to between the labyrinth packing 56*a* and the labyrinth packing 56*b* through the gas supply pipe 60 and the through hole 130 flows between the turbine rotor 25 and the gland labyrinth portion 50 in a direction of the nozzle diaphragm inner ring 123 and in a direction toward the outside of the steam turbine. The cooling gas or the heating gas flowing from the labyrinth packing 56*d* in a direction toward the outside of the steam turbine flows partially to between the inner casing 120 and the outer casing 121.

The cooling gas or the heating gas supplied to between the labyrinth packing 56*f* and the labyrinth packing 56*g* and between the labyrinth packing 56*h* and the labyrinth packing 56*i* through the gas supply pipe 60 and the through hole 131 flows between the turbine rotor 25 and the gland labyrinth portion 50 in a direction of the inner casing 120 and a direction toward the outside of the steam turbine. The cooling gas or the heating gas which flows from the labyrinth packing 56*i* in a direction toward the outside of the steam turbine is guided from for example, between the labyrinth packing 56*i* and the labyrinth packing 56*j* to the gland condenser 64 through the recovery pipe 63.

By configuring as described above, the side of the turbine rotor 25, which is near the nozzle diaphragm inner ring 123 and has a temperature easily increased, can be cooled efficiently. And, the plural through holes 131, 132 are formed as configured in the diaphragm 124 disposed at the end portion of the outer casing 121, and the cooling gas or the heating gas is supplied, so that the supply amount of the cooling gas or the heating gas corresponding to the individual portions where the cooling gas or the heating gas is supplied can be adjusted. Thus, the turbine rotor 25 can be cooled or heated optimally.

As shown in FIG. 8, in addition to the above-described structure shown in FIG. 4, a through hole 114 is formed in the diaphragm 110 to have its end between the first labyrinth packing 56*a* and the second labyrinth packing 56*b* counting from the final stage of the turbine rotor blade 111 toward the outside of the steam turbine, and the recovery pipe 63 may be connected to the through hole 114 to communicate with it. In other words, an open end portion 114*a* of the through hole 114 is formed between the first labyrinth packing 56*a* and the second labyrinth packing 56*b* counting from the final stage of the turbine rotor blade 111 toward the outside of the steam turbine, thereby configuring to recover the cooling gas or the heating gas from the open end portion 114*a*.

At the start or stop of the steam turbine, a pressure near the turbine rotor blade 111 is low, and the cooling gas or the heating gas, which is supplied at a pressure higher than the above pressure to between the labyrinth packing 56*b* and the labyrinth packing 56*c* through the gas supply pipe 60 and the through hole 112, flows between the turbine rotor 25 and the gland labyrinth portion 50 in a direction of the turbine rotor blade 111 and in a direction toward the outside of the steam turbine. And, the cooling gas or the heating gas that flows in the direction of the turbine rotor blade 111 is partially recovered from the open end portion 114*a* and guided to the gland condenser 64 through the recovery pipe 63. The cooling gas or the heating gas flowing in the direction toward the outside of the steam turbine is guided to the gland condenser 64 through the recovery pipe 63. Since the gland labyrinth portion 50 is also supplied with sealing steam through the sealing steam pipe 65 as described above, the sealing steam is also guided together with the cooling gas or the heating gas to the gland condenser 64 through the recovery pipe 63.

By configuring as described above, the turbine rotor 25 can be cooled or heated, and the flow rate of the cooling gas or the heating gas flowing toward the turbine rotor blade 111 can be suppressed.

As shown in FIG. 9, in addition to the above-described structure shown in FIG. 5, the diaphragm 110 is also formed with the through hole 114 having the open end portion 114*a* at a position opposed to the disk 113 to fix the final stage of the turbine rotor blade 111, and the recovery pipe 63 may be connected to the through hole 114 to communicate with it.

By configuring as described above, the cooling gas or the heating gas supplied to between the labyrinth packing 56*a* and the labyrinth packing 56*b* through the gas supply pipe 60 and the through hole 112 flows between the turbine rotor 25 and the gland labyrinth portion 50 in a direction of the turbine rotor blade III and in a direction toward the outside of the steam turbine. And, the cooling gas or the heating gas that flows in the direction of the turbine rotor blade III flows out toward the turbine rotor blade III and is recovered partially through the open end portion 114*a*, and guided to the gland condenser 64 through the recovery pipe 63. The cooling gas or the heating gas flowing in the direction toward the outside of the steam turbine is guided to the gland condenser 64 through the recovery pipe 63.

By configuring as described above, when the cooling gas is used, the side of the turbine rotor 25, which is near the turbine rotor blade III and has its temperature increased, can be cooled efficiently without increasing the supply pressure of the cooling gas. And, the cooling gas or the heating gas that flows out toward the turbine rotor blade III can be recovered partially.

The structure of a portion to supply the cooling gas or the heating gas to the intermediate labyrinth portion 55 is described below.

Figure 10:
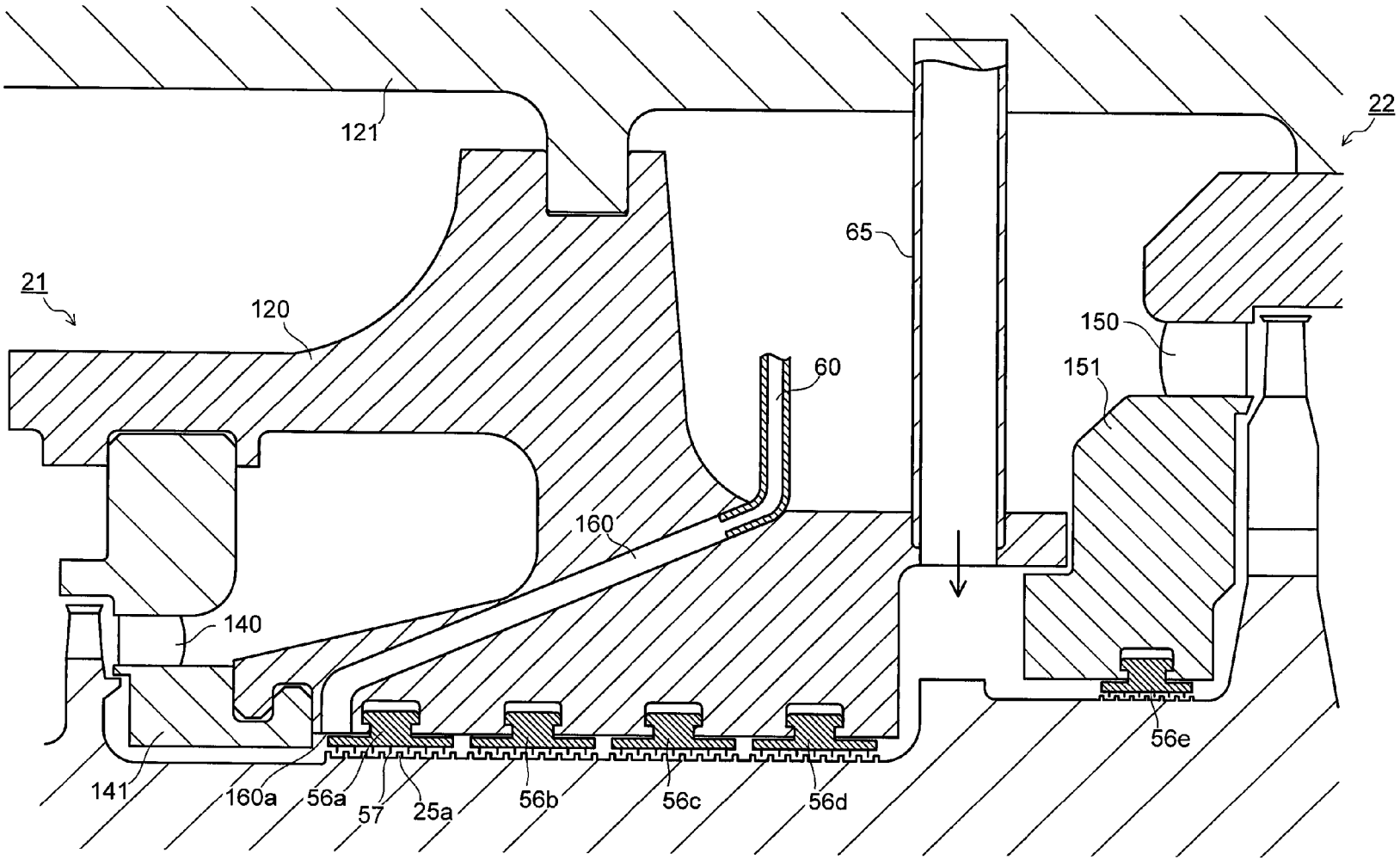
FIG. 10 is a diagram showing a cross section of an inlet side of the steam turbine having a structure to supply a cooling gas or a heating gas to an intermediate labyrinth portion.
Figure 11:
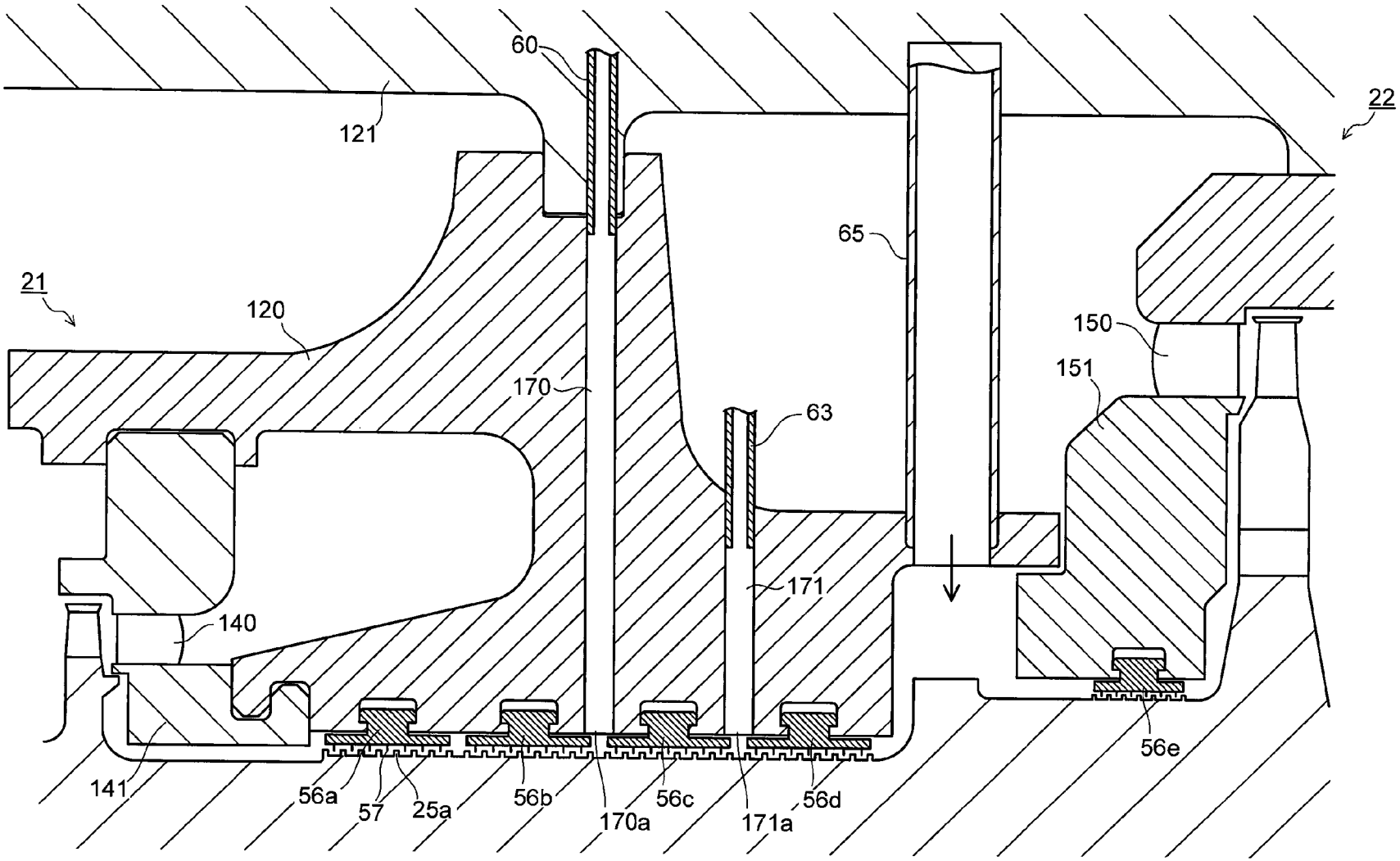
FIG. 11 is a diagram showing a cross section of an inlet side of the steam turbine having a structure to supply a cooling gas or a heating gas to the intermediate labyrinth portion and a structure to exhaust such gases.

FIG. 10 is a diagram showing a cross section of an inlet side of a steam turbine having a structure to supply the cooling gas or the heating gas to the intermediate labyrinth portion 55. FIG. 11 is a diagram showing a cross section of an inlet side of a steam turbine having a structure to supply the cooling gas or the heating gas to the intermediate labyrinth portion 55 and a structure to discharge such gases.

The intermediate labyrinth portion 55 shown in FIG. 10 suppresses steam from flowing from a first stage nozzle 140 side of the high-pressure turbine 21 to a first stage nozzle 150 side of the intermediate-pressure turbine 22 having a lower pressure in a structure that the high-pressure turbine 21 and the intermediate-pressure turbine 22 are housed in one casing. This casing is configured of a double casing of an inner casing 120 and an outer casing 121.

The inner casing 120 is provided with four labyrinth packings 56*a*, 56*b*, 56*c*, 56*d* along the turbine rotor 25 between a nozzle diaphragm inner ring 141 configuring the first stage nozzle 140 of the high-pressure turbine 21 and a nozzle diaphragm inner ring 151 configuring the first stage nozzle 150 of the intermediate-pressure turbine 22. And, the nozzle diaphragm inner ring 151 configuring the first stage nozzle 150 of the intermediate-pressure turbine 22 is provided with one labyrinth packing 56*e* along the turbine rotor 25. The number of labyrinth packings provided to the inner casing 120 and the nozzle diaphragm inner ring 151 is not particularly limited.

In the inner casing 120, a through hole 160 is formed through between the nozzle diaphragm inner ring 141 and the labyrinth packing 56*a* on the side of the high-pressure turbine 21 counting from the intermediate-pressure turbine 22 side to the high-pressure turbine 21 side, and the gas supply pipe 60 is connected to the through hole 160 to communicate with it. In other words, an open end portion 160*a* of the through hole 160 is formed between the nozzle diaphragm inner ring 141 and the labyrinth packing 56*a* on the side of the high-pressure turbine 21, thereby configuring to eject the cooling gas or the heating gas from the open end portion 160*a*.

The cooling gas or the heating gas ejected from the open end portion 160*a* between the nozzle diaphragm inner ring 141 and the labyrinth packing 56*a* adjacent to the nozzle diaphragm inner ring 141 has a high pressure on the side of the high-pressure turbine 21, so that it flows between the turbine rotor 25 and the intermediate labyrinth portion 55 in a direction of the intermediate-pressure turbine 22.

And, the sealing steam is supplied to between the labyrinth packing 56*d* disposed in the inner casing 120 and the labyrinth packing 56*e* disposed in the nozzle diaphragm inner ring 151 through, for example, a sealing steam pipe 65 as shown in FIG. 10.

By configuring as described above, the turbine rotor 25 can be cooled or heated. Especially, when the cooling gas is used, the inner casing 120 can be cooled by the cooling gas because the through hole 160 is formed in the inner casing 120 from the labyrinth packing 56*d* side to the labyrinth packing 56*a* side. Thus, the labyrinth packings 56*a*, 56*b*, 56*c*, 56*d* fixed to the inner casing 120 are prevented from having a temperature increase, and the turbine rotor 25 can be prevented from being heated by radiation heat from the labyrinth packings 56*a*, 56*b*, 56*c*.

In the inner casing 120 shown in FIG. 11, a through hole 170 is formed through between the second labyrinth packing 56*b* and the third labyrinth packing 56*c* counting from the nozzle diaphragm inner ring 141 toward the intermediate-pressure turbine 22 side, and the gas supply pipe 60 is connected to the through hole 170 to communicate with it. In other words, an open end portion 170*a* of the through hole 170 is formed between the second labyrinth packing 56*b* and the third labyrinth packing 56*c* from the nozzle diaphragm inner ring 141 toward the intermediate-pressure turbine 22 side, thereby configuring to eject the cooling gas or the heating gas from the open end portion 170*a*.

A through hole 171 is further formed in the inner casing 120 through between the third labyrinth packing 56*c* and the fourth labyrinth packing 56*d* counting from the nozzle diaphragm inner ring 141 toward the intermediate-pressure turbine 22 side, and the recovery pipe 63 may be connected to the through hole 171 to communicate with it. In other words, an open end portion 171*a* of the through hole 171 is formed between the third labyrinth packing 56*c* and the fourth labyrinth packing 56*d* counting from the nozzle diaphragm inner ring 141 toward the intermediate-pressure turbine 22 side, thereby configuring to recover the cooling gas or the heating gas from the open end portion 171*a*. Since sealing steam is also supplied to the intermediate labyrinth portion 55 through the sealing steam pipe 65, the sealing steam is also guided partially together with the cooling gas or the heating gas to the gland condenser 64 through the recovery pipe 63.

By configuring as described above, the turbine rotor 25 can be cooled or heated, and the flow rate of the cooling gas or the heating gas flowing out to the intermediate-pressure turbine 22 side can be suppressed.

A method of controlling each supply amount of the cooling gas, the heating gas or the sealing steam in the steam turbine provided with the gas supply system according to the present invention described above is described below.

First, a method of controlling the steam turbine when it is started is described. Since the turbine rotor 25 is cooled at the start of the steam turbine, the cooling gas is supplied to the labyrinth portion through the gas supply pipe 60. If the cooling gas supplied through the gas supply pipe 60 has a temperature lower than the optimum temperature for supplying, the cooling gas may be heated to a predetermined temperature by, for example, controlling the switching valve 61 to flow the cooling gas which flows out of the gas supply portion 70 to the passage provided with the heat exchanger 80.

Figure 12:
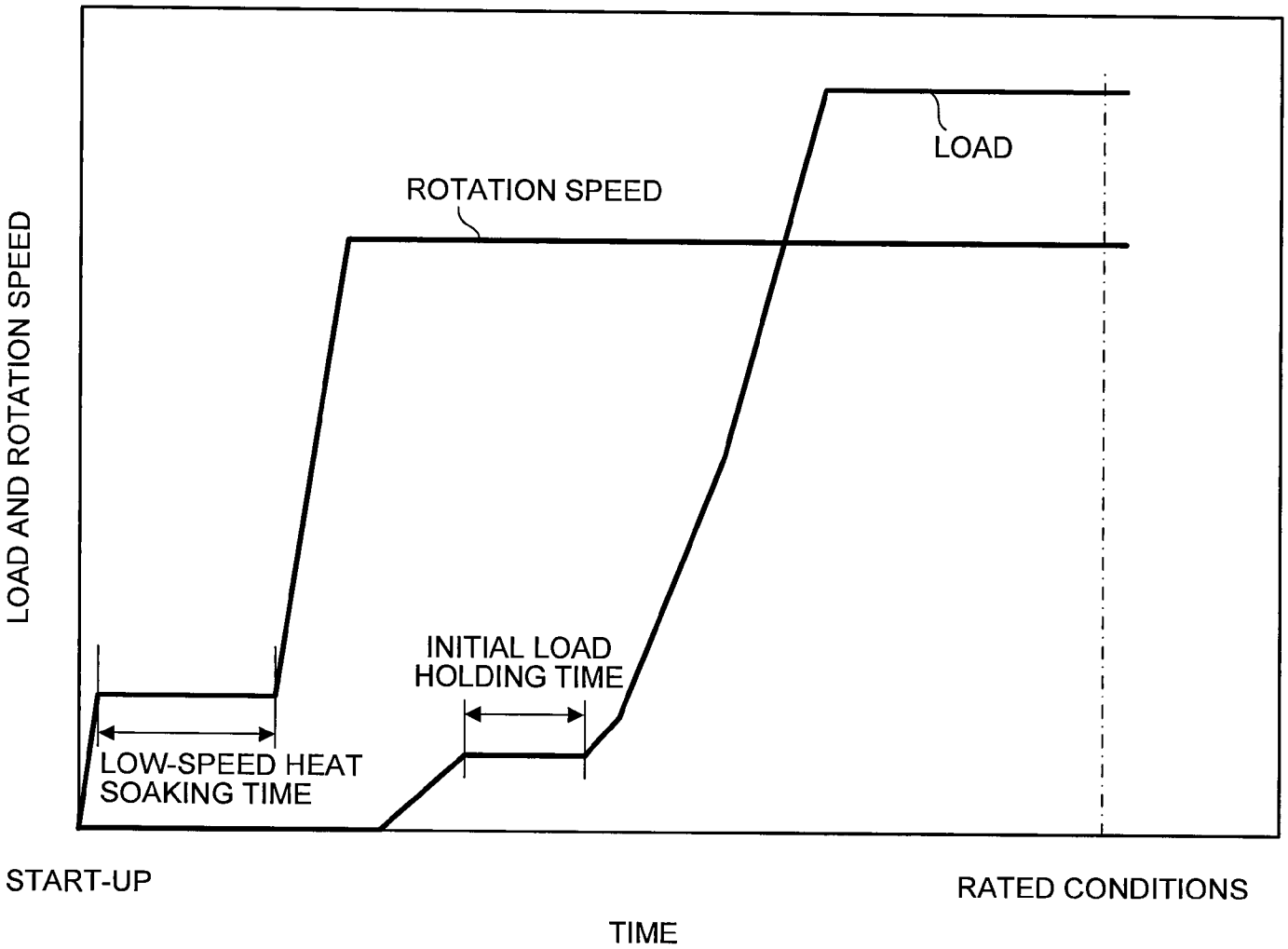
FIG. 12 is a diagram showing an operation procedure of the steam turbine from its start to rated conditions.
Figure 13:
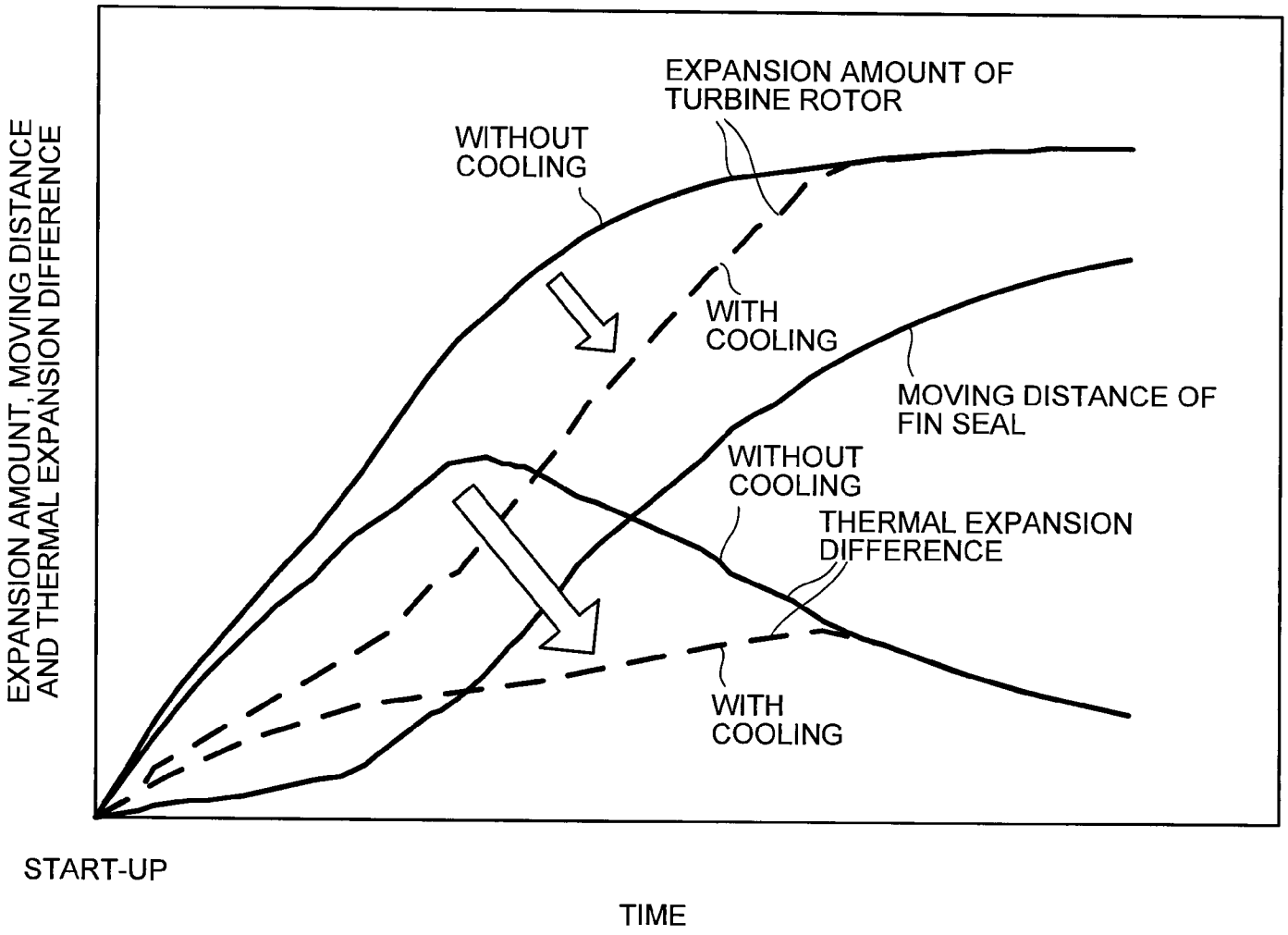
FIG. 13 is a diagram showing thermal expansion differences with and without the gas supply system of the invention during the start-up operation procedure shown in FIG. 12.

FIG. 12 is a diagram showing an operation procedure of the steam turbine from its start to rated conditions. FIG. 13 is a diagram showing thermal expansion differences during the start-up of the steam turbine according to the operation procedure shown in FIG. 12 with and without the gas supply system according to the invention.

As shown in FIG. 12, after the start-up of the steam turbine, the turbine rotor 25 is held to have a predetermined number of low rotations under application of no load. Time for keeping such a state is called low-speed heat soaking time. After a lapse of the low-speed heat soaking time, the turbine rotor 25 is increased to the rated rotation speed. At that time, the steam turbine is in a state with application of no load. After the turbine rotor 25 is increased to the rated rotation speed, a load is applied gradually, and a state under a predetermined load is maintained for a given time. The time for maintaining such a state is called initial load holding time. After a lapse of the initial load holding time, the load is increased to have a rated load condition.

At the start of the steam turbine, the turbine rotor 25 rotates at a low speed even if the mainstream of steam has a small flow rate, so that the temperature increases gradually due to windage loss or the like, and an amount of an axial expansion increases. Meanwhile, since a casing part including the labyrinth portion has a large thermal capacity, the temperature increase becomes moderate. Therefore, a difference between the axial expansion amount of the turbine rotor 25 and the axial moving distance of the labyrinth portion increases.

As shown in FIG. 13, during the start-up operation of the steam turbine according to the above-described operation procedure, the gas supply system supplies the cooling gas to the gland labyrinth portion 50 and the intermediate labyrinth portion 55 to cool the turbine rotor 25, and an increase rate of the axial expansion becomes moderate in comparison with a case where cooling is not performed. Therefore, the thermal expansion difference which is a difference between the axial expansion amount of the turbine rotor 25 and the axial moving distance of the seal fins 57 of the labyrinth portion becomes smaller when the turbine rotor 25 is cooled in comparison with the case when not cooled. And, as shown in FIG. 13, a variation in thermal expansion difference from the start-up to the rated conditions also becomes smaller when the turbine rotor 25 is cooled in comparison with the case when not cooled.

When the turbine rotor 25 is not cooled, the thermal expansion difference becomes large, the seal fins 57 positioned between the protruded threads 25*a* which are protruded in the radial direction of the turbine rotor 25 might come into contact with the protruded threads 25*a* (see FIG. 3). But, when the gas supply system according to the invention is provided and the turbine rotor 25 is cooled, the contact between the seal fins 57 and the protruded threads 25*a* can be prevented because the thermal expansion difference is small.

A case where the steam turbine is provided with the gas supply system according to the invention and cools the turbine rotor 25 during the start-up, and the start-up time is determined to be shorter than the ordinary start-up time as shown in FIG. 12 is described below.

Figure 14:
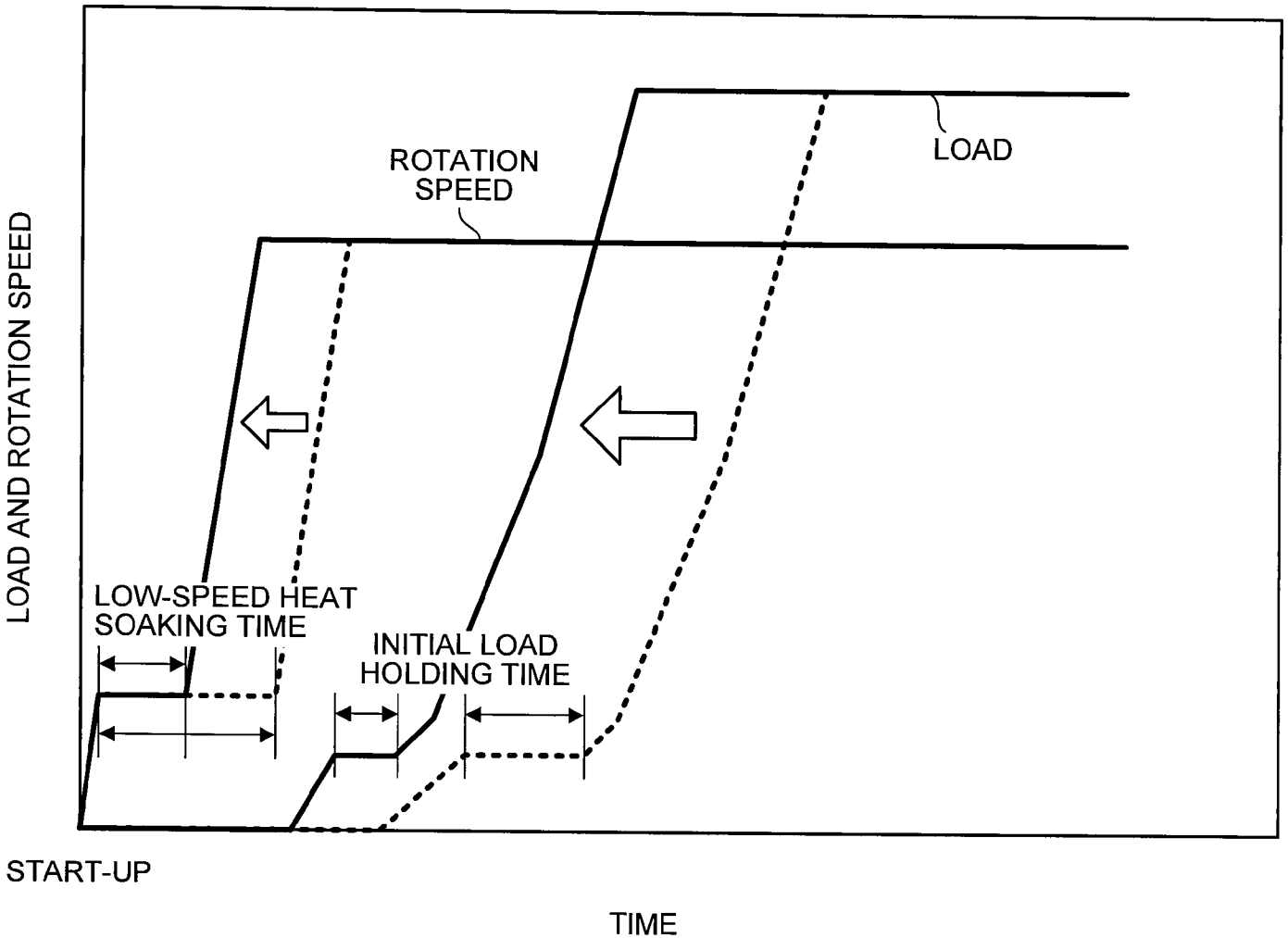
FIG. 14 is a diagram showing an operation procedure of the steam turbine from its start to rated conditions.
Figure 15:
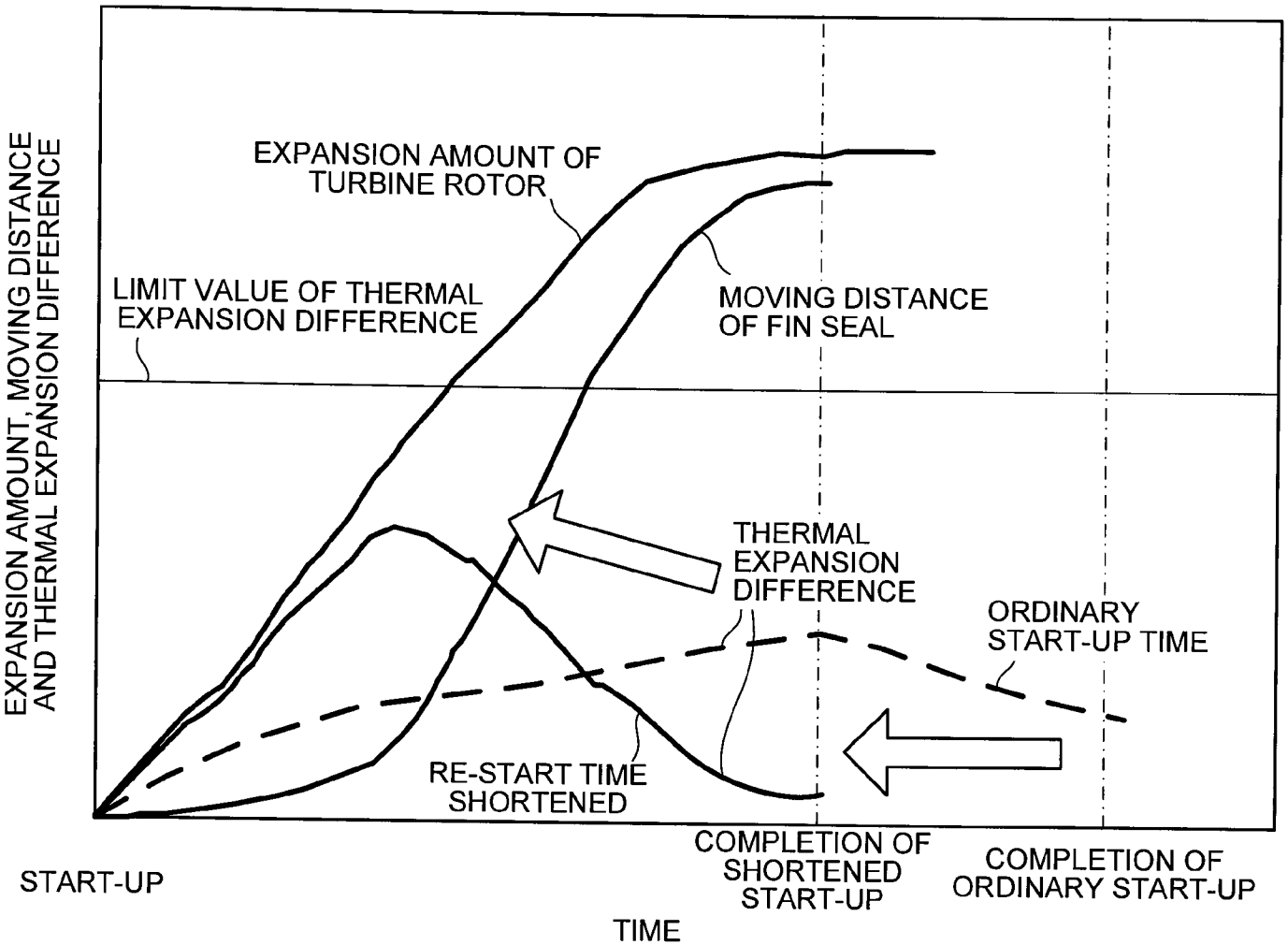
FIG. 15 is a diagram showing thermal expansion differences and others during the start-up operation procedure shown in FIG. 14.

FIG. 14 is a diagram showing an operation procedure of the steam turbine from its start to rated conditions. FIG. 15 is a diagram showing thermal expansion differences and the like during the start-up operation of the steam turbine according to the operation procedure shown in FIG. 14. FIG. 15 shows an operation procedure at an ordinary start-up time by a dotted line.

As shown in FIG. 14, the start-up time is decreased by decreasing the low-speed heat soaking time and the initial load holding time.

As shown in FIG. 15, the maximum value of the thermal expansion difference increases in comparison with the case of the start-up operation of the steam turbine in the ordinary start-up time, but the maximum value can be suppressed to a value lower than the limit value of the thermal expansion difference. Here, the limit value of the thermal expansion difference is a maximum thermal expansion difference which can be allowed in a range that the seal fins 57 positioned between the protruded threads 25*a* protruded in the radial direction of the turbine rotor 25 and the protruded threads 25*a* are not contacted mutually when the thermal expansion difference becomes large.

Thus, the start-up time of the steam turbine can be decreased by cooling the turbine rotor 25 at the start using the gas supply system according to the invention.

Control of the gas supply amount is described below.

Figure 16:
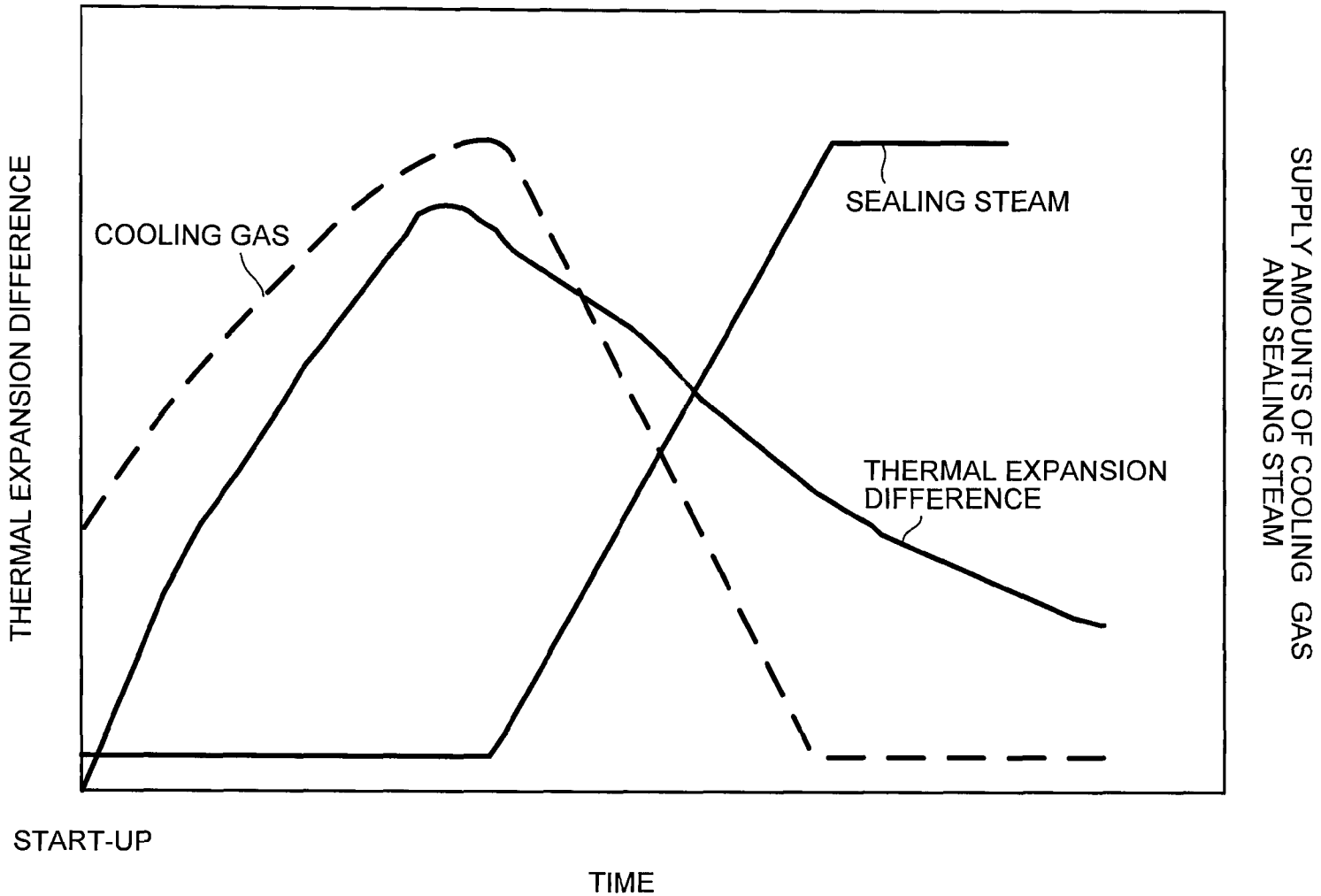
FIG. 16 is a diagram showing a relationship between the thermal expansion difference and the supply amounts of gas and sealing steam during the start-up operation of the steam turbine.
Figure 17:
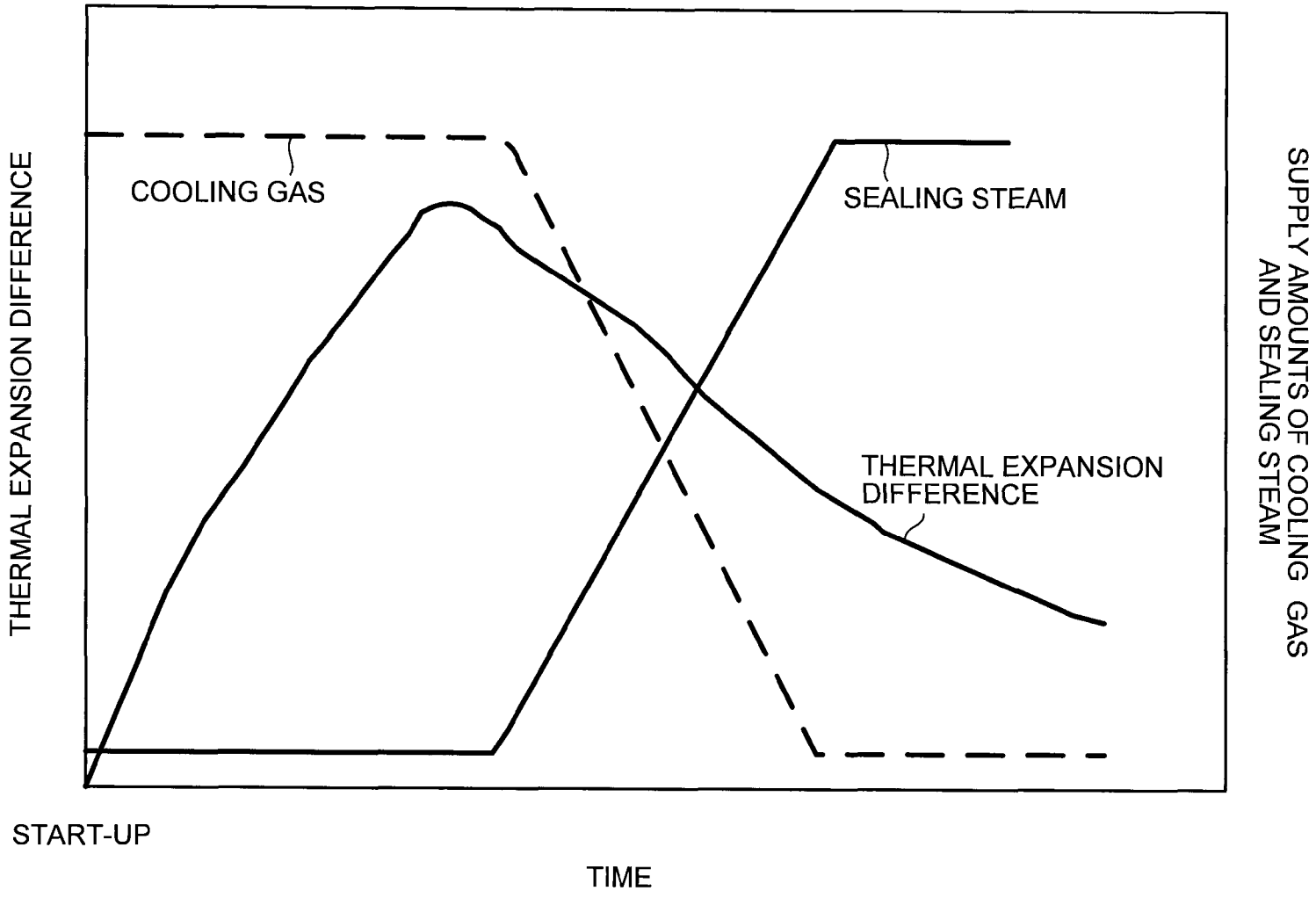
FIG. 17 is a diagram showing a relationship between the thermal expansion difference and the supply amounts of gas and sealing steam during the start-up operation of the steam turbine.

FIG. 16 and FIG. 17 are diagrams showing a relationship between a thermal expansion difference and the supply amounts of cooling gas and sealing steam at the start of the steam turbine.

The controller 100 adjusts the supply amounts of the cooling gas and the sealing steam by adjusting the switching valve 61 and the flow control valves 62, 66 according to the detection information from the expansion detector 90 and the movement detector 91. Here, for control at the start of the steam turbine, the cooling gas is supplied to the labyrinth portion through the gas supply pipe 60. Therefore, the controller 100 controls the switching valve 61 to flow the cooling gas flowing out of the gas supply portion 70 to a passage not provided with the heat exchanger 80.

As shown in FIG. 16, the controller 100 calculates a thermal expansion difference according to the detection information from the expansion detector 90 and the movement detector 91, and controls the flow control valve 62 in correspondence with a temporal variation of the thermal expansion difference to adjust the supply amount of the cooling gas. Specifically, if the thermal expansion difference increases, the supply amount of the cooling gas is increased in accordance with its increased amount. In other words, cooling of the turbine rotor 25 is promoted to suppress the thermal expansion difference. At this time, the supply amount of the sealing steam supplied to the labyrinth portion through the sealing steam pipe 65 is limited to, for example, substantially a predetermined low flow rate of 5 to 20% of the supply amount of the sealing steam during the rated operation.

When the controller 100 judges according to the detection information from the expansion detector 90 and the movement detector 91 that the thermal expansion difference indicates a maximum value and starts to decrease, the controller 100 controls the flow control valve 62 to decrease the supply amount of the cooling gas and controls the flow control valve 66 to increase the supply amount of the sealing steam. And, the supply amount of the cooling gas is suppressed to, for example, substantially a predetermined low flow rate of 10% or less of the maximum supply amount, and the supply amount of the sealing steam is increased to a predetermined flow rate for supplying at the rated operation and then maintained constant at that flow rate.

Here, as shown in FIG. 17, the cooling gas may be supplied in the maximum supply amount, which is supplied when the turbine rotor 25 is cooled, at the start of the turbine rotor, and that supply amount may be continued until it is judged that the thermal expansion difference starts to decrease from the start-up.

A control method of a steam turbine when it is stopped is described below.

Figure 18:
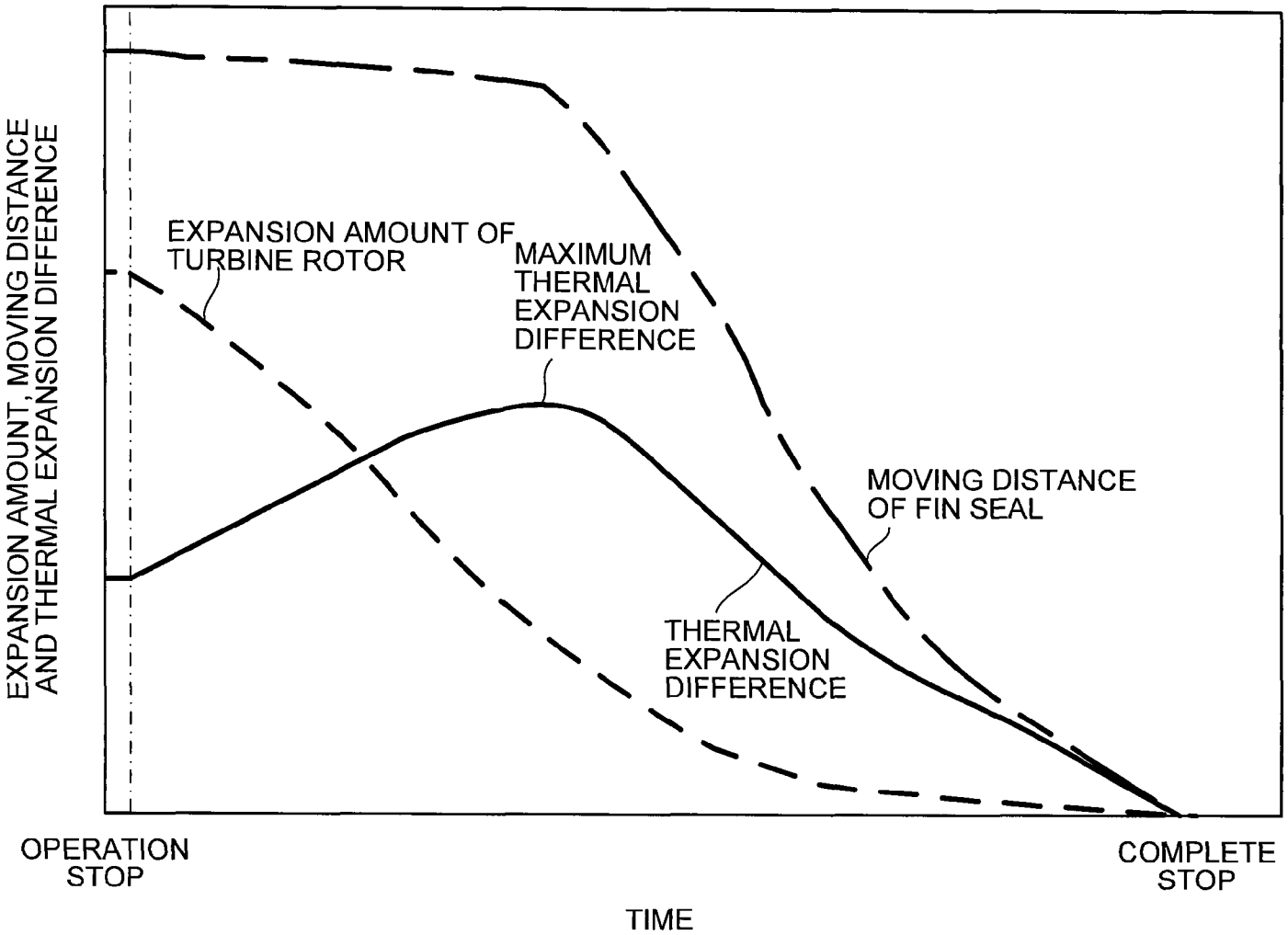
FIG. 18 is a diagram showing a thermal expansion difference and others from the rated operation of the steam turbine through the shutdown operation, to complete stop of the steam turbine.
Figure 19:
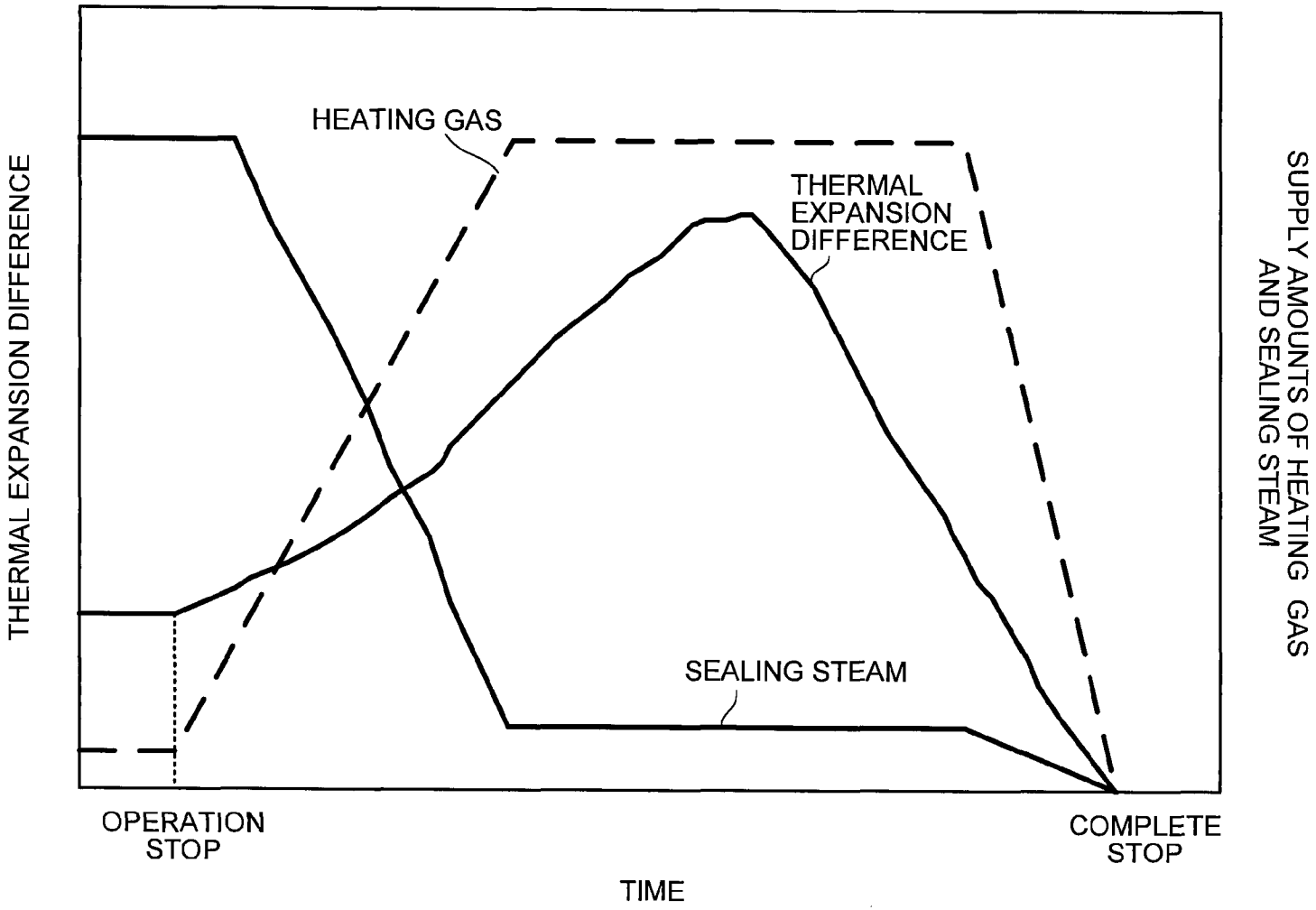
FIG. 19 is a diagram showing a relationship between the thermal expansion difference and the supply amounts of a heating gas and sealing steam when the steam turbine is stopped.
Figure 20:
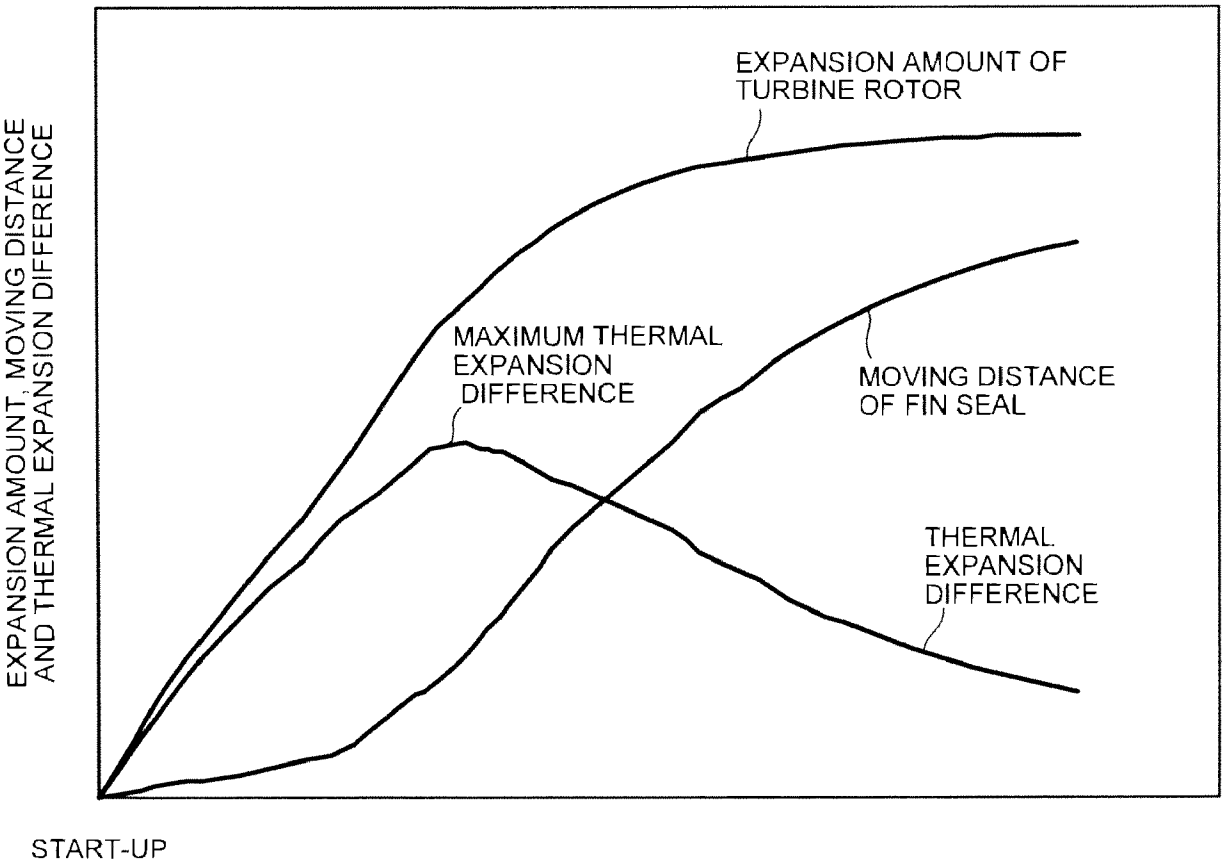
FIG. 20 Prior Art
FIG. 20 is a diagram showing a thermal expansion difference which is a difference between an axial expansion amount of the turbine rotor and an axial moving distance of seal fins of a labyrinth portion due to thermal expansion of the casing during an start-up of a conventional steam turbine.

FIG. 18 is a diagram showing a thermal expansion difference and others from the rated operation of the steam turbine, through the shutdown operation to the complete stop of the steam turbine. FIG. 19 is a diagram showing a relationship between the thermal expansion difference and the supply amounts of a heating gas and sealing steam when the steam turbine is stopped.

During the shutdown operation of the steam turbine, a temperature drop of the turbine rotor 25 having a small thermal capacity is fast, and a temperature drop of the casing part containing the labyrinth portion having a large thermal capacity is slow. Therefore, as shown in FIG. 18, an amount of an axial expansion of the turbine rotor 25 decreases monotonously from the beginning of the shutdown operation of the steam turbine. Meanwhile, the moving distance of the labyrinth portion does not decrease substantially for a predetermined duration from the beginning of the shutdown operation and decreases sharply after a predetermined duration elapses. Therefore, the thermal expansion difference increases from the beginning of the shutdown operation to the time when the moving distance of the labyrinth portion starts to decrease sharply, and the thermal expansion difference shows the maximum value when the moving distance of the labyrinth portion starts to decrease sharply.

Accordingly, the turbine rotor 25 is heated to suppress the thermal expansion difference. Therefore, after the shutdown operation of the steam turbine, the heating gas is supplied to the labyrinth portion through the gas supply pipe 60.

As shown in FIG. 19, when the controller 100 judges according to the detection information from the expansion detector 90 and the movement detector 91 that the thermal expansion difference has started to increase with respect to the thermal expansion difference at the time of the rated operation, the controller 100 controls the switching valve 61 to flow the cooling gas which flows out of the gas supply portion 70 to the passage provided with the heat exchanger 80. The cooling gas having flowed through the passage is heated to a predetermined temperature to become the heating gas. The controller 100 also controls the flow control valve 62 when it controls the switching valve 61 to increase the supply amount of the heating gas and controls the flow control valve 66 to decrease the supply amount of the sealing steam. After the supply amount of the heating gas is increased to the maximum supply amount to be supplied when the turbine rotor 25 is heated, its flow rate is maintained constant, and the supply amount of the sealing steam is suppressed to, for example, substantially a predetermined low flow rate of 5 to 20%.

A shutdown of the steam turbine may be judged according to, for example, information inputted from the main control portion and other measuring equipment of the steam turbine.

The controller 100 judges according to the detection information from the expansion detector 90 and the movement detector 91 that the thermal expansion difference has become a predetermined value and controls the flow control valves 62, 66 to stop the supply of the heating gas and the sealing steam by decreasing them. Thus, the steam turbine is completely stopped.

When the controller 100 judges that the thermal expansion difference has started to increase and controls the flow control valve 62 to increase the supply amount of the heating gas, the controller 100 calculates a thermal expansion difference according to the detection information from the expansion detector 90 and the movement detector 91, and may control the flow control valve 62 in accordance with a temporal variation of the thermal expansion difference to adjust the supply amount of the heating gas. Specifically, if the thermal expansion difference increases, the supply amount of the heating gas may be increased in accordance with its increased amount.

As described above, the steam turbine according to the invention cools the turbine rotor 25 during the start-up of the steam turbine to suppress the expansion of the turbine rotor 25 in the axial direction thereof, and the thermal expansion difference which is a difference between the amount of the axial expansion and the axial moving distance of the seal fins 57 of the labyrinth portion can be minimized. And, the turbine rotor 25 is heated during the shutdown operation of the steam turbine, so that abrupt contraction of the turbine rotor 25 in the axial direction thereof is suppressed, and the thermal expansion difference which is a difference between the amount of the axial expansion of the turbine rotor 25 and the axial moving distance of the seal fins 57 of the labyrinth portion can be minimized. Therefore, the contact between the seal fins 57 of the labyrinth portion and the protruded threads 25*a* formed on the circumferential surface of the turbine rotor 25 can be prevented, and reliability at the operation of the steam turbine can be improved. Besides, since the above-described thermal expansion difference can be minimized, the intervals of the seal fins 57 in the axial direction of the turbine rotor at the labyrinth portion can be made small. Thus, the performance of the steam turbine can be improved.

Even when the low-speed heat soaking time or the initial load holding time is decreased, the thermal expansion difference can be suppressed to be smaller than the thermal expansion difference limit value. Thus, it becomes possible to shorten the low-speed heat soaking time or the initial load holding time, and the start-up time of the steam turbine can be shortened.

The steam turbine according to the invention can use air in the atmosphere as a cooling medium or a heating medium for the turbine rotor 25 without using steam extracted from the steam turbine. Thus, a decrease in efficiency of the steam turbine due to the extraction of steam from the steam turbine can be avoided. Besides, air in the atmosphere can be used with ease without considering condensation or the like due to lowering of a temperature which occurs when steam is used.

The steam turbine according to the invention calculates the thermal expansion difference by the controller 100 according to the detection formation from the expansion detector 90 and the movement detector 91 and adjusts the switching valve 61 and the flow control valves 62, 66 according to the thermal expansion difference, thereby enabling to adjust the supply amounts of the cooling gas, the heating gas and the sealing steam. Thus, the supply amounts of the cooling gas, the heating gas and the sealing steam can be adjusted instantly and accurately.

Although the invention has been described above by reference to the embodiments of the invention, the invention is not limited to the embodiments described above. It is to be understood that modifications and variations of the embodiments can be made without departing from the spirit and scope of the invention.

What is claimed is:

1. A steam turbine, comprising:

a casing;

a turbine rotor disposed through the casing;

a labyrinth portion provided circumferentially along the turbine rotor between the casing and the turbine rotor;

a gas supply system configured to supply cooling air for the turbine rotor to the labyrinth portion when starting the steam turbine;

a sealing steam supply system configured to supply sealing steam to the labyrinth portion;

an expansion detector configured to detect an amount of a thermal expansion of the turbine rotor in the axial direction;

a movement detector configured to detect an axial moving distance of a sealing portion of the labyrinth portion in the axial direction of the turbine rotor; and a controller configured to:

calculate a thermal expansion difference between the turbine rotor and the labyrinth portion based on detection information detected by the expansion detector and the movement detector, control the gas supply system to increase a supply amount of the cooling air according to an increased amount of the thermal expansion difference when the thermal expansion difference is increased, and control the gas supply system and the sealing steam supply system to decrease the supply amount of the cooling air and increase a supply amount of the sealing steam when the thermal expansion difference is decreased.

2. The steam turbine according to claim 1, further comprising, a gas recovery system configured to recover the cooling air supplied to the labyrinth portion.

3. A steam turbine, further comprising:

a casing;

a turbine rotor disposed through the casing;

a labyrinth portion provided circumferentially along the turbine rotor between the casing and the turbine rotor;

a gas supply system configured to supply heating air for the turbine rotor to the labyrinth portion when stopping the steam turbine;

a sealing steam supply system configured to supply sealing steam to the labyrinth portion;

an expansion detector configured to detect an amount of a thermal expansion of the turbine rotor in the axial direction;

a movement detector configured to detect an axial moving distance of a sealing portion of the labyrinth portion in the axial direction of the turbine rotor; and a controller configured to:

calculate a thermal expansion difference between the turbine rotor and the labyrinth portion based on detection information detected by the expansion detector and the movement detector, and control the gas supply system and the sealing steam supply system to increase a supply amount of the heating air and decrease a supply amount of the sealing steam when the thermal expansion difference is increased.

4. A method of cooling a steam turbine including:

a casing;

a turbine rotor disposed through the casing;

a labyrinth portion provided circumferentially along the turbine rotor between the casing and the turbine rotor;

a sealing steam supply system configured to supply sealing steam to the labyrinth portion;

a gas supply system configured to supply cooling air for the turbine rotor to the labyrinth portion;

an expansion detector configured to detect an amount of a thermal expansion of the turbine rotor in the axial direction; and a movement detector configured to detect an axial moving distance of a sealing portion of the labyrinth portion in the axial direction of the turbine rotor, wherein the method comprises:

calculating a thermal expansion difference between the turbine rotor and the labyrinth portion based on detection information detected by the expansion detector and the movement detector;

increasing a supply amount of cooling air from the gas supply system according to an increased amount of the thermal expansion difference when the thermal expansion difference is increased; and decreasing a supply amount of cooling air and increasing a supply amount of the sealing steam when the thermal expansion difference is decreased.

5. A method of cooling a steam turbine including:

a casing;

a turbine rotor disposed through the casing;

a labyrinth portion provided circumferentially along the turbine rotor between the casing and the turbine rotor;

a sealing steam supply system configured to supply sealing steam to the labyrinth portion;

a gas supply system configured to supply heating air for the turbine rotor to the labyrinth portion;

an expansion detector configured to detect an amount of a thermal expansion of the turbine rotor in the axial direction; and a movement detector configured to detect an axial moving distance of a sealing portion of the labyrinth portion in the axial direction of the turbine rotor, wherein the method comprises:

calculating a thermal expansion difference between the turbine rotor and the labyrinth portion based on detection information detected by the expansion detector and the movement detector;

increasing a supply amount of heating air when the thermal expansion difference is increased; and decreasing a supply amount of sealing steam when the thermal expansion difference is increased.

* * * * *